US005890038A

United States Patent [19]

Ohsawa et al.

[11] Patent Number: 5,890,038

[45] **Date of Patent: *Mar. 30, 1999**

[54] IMAGE FORMING APPARATUS IN WHICH CARRYING FORCE FOR A MIXING TONER BY A TONER CARRYING MEMBER IS MADE SMALL

[75] Inventors: Keishi Ohsawa, Yokohama; Yoshiaki Kobayashi, Soka; Fumiteru Gomi, Tokyo, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 598,100

[22] Filed: Feb. 7, 1996

[30] Foreign Application Priority Data

| | | | |
|---|---|---|---|
| Feb. 8, 1995 | [JP] | Japan | 7-042632 |
| Feb. 8, 1995 | [JP] | Japan | 7-042634 |
| Feb. 20, 1995 | [JP] | Japan | 7-056739 |
| Jul. 3, 1995 | [JP] | Japan | 7-189836 |

[51] Int. Cl.[6] ..... G03G 15/08

[52] U.S. Cl. ..... 399/228; 399/274; 399/284; 430/45

[58] Field of Search ..... 355/326 R, 327, 355/245, 246; 430/45; 399/228, 274, 284

[56] References Cited

U.S. PATENT DOCUMENTS

| | | | |
|---|---|---|---|
| 4,599,285 | 7/1986 | Haneda et al. | 430/54 |
| 4,679,929 | 7/1987 | Haneda et al. . | |
| 4,710,016 | 12/1987 | Waatanabe . | |

(List continued on next page.)

FOREIGN PATENT DOCUMENTS

| | | |
|---|---|---|
| 58-082263 | 5/1983 | Japan . |
| 58-137846 | 8/1983 | Japan . |
| 60-28676 | 2/1985 | Japan . |
| 61-007852 | 1/1986 | Japan . |
| 63-294579 | 12/1988 | Japan . |
| 63-294580 | 12/1988 | Japan . |
| 7-44023 | 2/1995 | Japan . |

OTHER PUBLICATIONS

*Patent Abstracts of Japan,* vol. 14, No. 5 (p. 123), Section P, Sect. No. 1127, JP–A–0210466, Aug. 21, 1990.

*Patent Abstracts of Japan,* vol. 14, No. 1 (p. 97), Section P, Sect. No. 1013, JP–A–01307775, Dec. 12, 1989.

*Patent Abstracts of Japan,* vol. 14, No. 72, (p. 37), Section P, Sect. No. 1004, JP–A–01289979, Nov. 21, 1989.

*Patent Abstracts of Japan,* vol. 13, No. 488, (p. 29), Section P, Sect. No. 954, JP–A–01193887, Aug. 3, 1989.

*Patent Abstracts of Japan,* vol. 12, No. 415, (p. 43), Section P, Sect. No. 781, JP–A–63151967, Jun. 24, 1988.

*Patent Abstracts of Japan,* vol. 11, No. 331, (p. 159), Section P, Sect. No. 630, JP–A–62115172, May 26, 1987.

*Patent Abstracts of Japan,* vol. 1, No. 327, (p. 19), Section P, Sect. No. 513, JP–A–61132965, Jun. 20, 1986.

*Patent Abstracts of Japan,* vol. 8, No. 1291, (p. 30), Section P, Sect. No. 280, JP–A–59031971, Aug. 17, 1982.

*Patent Abstracts of Japan,* vol. 8, No. 1291, (p. 30), Section P, Sect. No. 280, JP–A–59031970, Aug. 17, 1982.

*Patent Abstracts of Japan,* vol. 8, No. 1291, (p. 29), Section P, Sect. No. 280, JP–A–59031969, Feb. 21, 1984.

*Primary Examiner*—Richard Moses

*Attorney, Agent, or Firm*—Fitzpatrick, Cella, Harper & Scinto

[57] ABSTRACT

An image forming apparatus includes an image bearing member on which first and second electrostatic images are formed, a first developing device for developing the first electrostatic image on the image bearing member with a first toner, and a second developing device for developing the second electrostatic image on the image bearing member bearing the first toner image thereon with a second toner. The second developing device has a toner carrying member opposed to the image bearing member and carrying the toners thereon. The force with which the first toner, having mixed into the second developing device, is carried on the toner carrying member is smaller than the force with which the second toner is carried on the toner carrying member.

17 Claims, 15 Drawing Sheets

U.S. PATENT DOCUMENTS

| | | | |
|---|---|---|---|
| 4,731,313 | 3/1988 | Haneda | 430/42 |
| 4,822,702 | 4/1989 | Hoshi et al. | 430/42 |
| 4,887,102 | 12/1989 | Yoshikawa et al. | 355/246 X |
| 5,030,996 | 7/1991 | Tajima et al. | 355/246 |
| 5,066,979 | 11/1991 | Goto et al. | 355/326 R |
| 5,122,843 | 6/1992 | Yokoyama et al. | 355/326 R |
| 5,187,523 | 2/1993 | Osawa | 355/251 |
| 5,187,535 | 2/1993 | Tajima | 355/326 R |
| 5,276,487 | 1/1994 | Akinaga et al | 355/245 |
| 5,418,097 | 5/1995 | Furuya et al. | 430/45 X |
| 5,532,801 | 7/1996 | Mizoguchi | 355/246 |

IMAGE FORMING APPARATUS IN WHICH CARRYING FORCE FOR A MIXING TONER BY A TONER CARRYING MEMBER IS MADE SMALL

BACKGROUND OF THE INVENTION

1. Field of the Invention

This invention relates to an image forming apparatus such as a copying apparatus, a printer or a facsimile apparatus, and particularly to an image forming apparatus capable of forming two-color images.

2. Related Background Art

A method of forming two-color images according to the prior art will hereinafter be described.

The surface of an electrophotographic photosensitive drum (photosensitive medium) is uniformly charged by a charger, whereafter first exposure is effected to form a first latent image, which is then developed by a first developing device by the use of a first toner, and then the surface of the photosensitive drum is again uniformly charged by a re-charger, whereafter second exposure is effected to form a second latent image, which is then developed by a second developing device by the use of a second toner differing in color from the first toner, whereby a two-color image by the toners of two colors is formed on the photosensitive drum. This is a so-called two-color multiplex developing method.

Such a two-color multiplex developing method has suffered from the problem that the first toner, adhering to the first latent image on the photosensitive drum in the development, mixes into the second developing device with an increase in the number of image formation sheets and the turbidity of the colors occurs on the two-color image obtained.

This problem is remarkable particularly when the two-component magnetic brush developing method is used in the second development. This is because the first toner, adhering to the first latent image on the photosensitive drum, is mechanically stripped off by its contact-with the ears of the magnetic brush of the two-component developer.

Accordingly, to prevent the mixing of the first toner into the second developing device, it is more advantageous to use in the second development a non-contact developing method in which the first toner is not stripped off by the contact of the second toner. Further, by applying to the second developing device an AC bias (AC electric field) or an alternate bias (alternate electric field) comprising a DC voltage superposed on an AC voltage as a developing bias, the qualities of image such as density and harmony are improved.

As the technique of preventing the mixing and color-mixing of the toner in the developing device on the rear stage, it has been proposed to make the particle diameter of the toner in the developing device on the rear stage larger (Japanese Laid-Open Patent Application No. 58-82263), to make the amount of charge of the toner great (Japanese Laid-Open Patent Application No. 58-137846) or to make the mass, the average particle diameter and the specific gravity of the toner great (Japanese Laid-Open Patent Application Nos. 61-7852, 63-294579 and 63-294580).

However, the mixing of the first toner is not entirely eliminated by even such measures. That is, when the first toner of a negative polarity, adhering to the first latent image of the negative polarity on the photosensitive drum by the first development, has arrived at a second developing area on which the developing sleeve of the second developing device is disposed with the rotation of the photosensitive drum, the first toner and the second toner exhibit the same behavior because they are of the same polarity, and in some cases, the first toner on the photosensitive drum also reciprocally moves between the photosensitive drum and the developing sleeve of the developing device and is stripped off the photosensitive drum and mixes into the second developing device.

The foregoing will hereinafter be explained by the use of the potential model of FIG. 6 of the accompanying drawings. FIG. 6 shows the change of the charging potential of the surface of the photosensitive drum when the photosensitive drum has been uniformly charged to the negative by corona charging, exposed, and developed. In FIG. 6, VD1 indicates the potential of an unexposed portion, and VL1 indicates the potential of the first latent image, i.e., the potential of the exposed portion of the first image. VT1+L1 indicates the potential of the toner layer on the photosensitive drum, and VDC1 indicates the DC voltage of the first developing bias (AC voltage+DC voltage) when the exposed portion of the first image of VL1 is reversely developed. Also, VDC2 indicates the DC voltage of the second developing bias (AC voltage+DC voltage) when the exposed portion of the second image (the second latent image) is reversely developed.

The first image portion obtained by the exposed portion of the first image on the photosensitive drum being subjected to the first development has its potential VL1+T1 raised to a potential VL1+T1' by re-charging. This potential after the re-charging is set to a level higher than the DC bias DC2 of the second development in order to prevent the second toner from adhering to the toner image of the first image portion on the photosensitive drum during the second development to thereby cause fogging. Thus, the converse bias Vb of the DC part for stripping in the figure is applied and it may happen that the first toner is stripped off. Accordingly, 100% prevention of mixing is very difficult and during long-period use, with an increase in the number of image formation sheets, the first toner mixes into the second developing device via the developing sleeve thereof, and accumulates therein to thereby cause color mixing.

SUMMARY OF THE INVENTION

It is an object of the present invention to provide an image forming apparatus in which color mixing will not occur, even if a toner mixes into a second developing device.

It is another object of the present invention to provide an image forming apparatus in which a first toner, having mixed into a second developing device, can be simply separated and collected.

It is still another object of the present invention to provide an image forming apparatus having:

an image bearing member;

electrostatic image forming means for forming first and second electrostatic images on said image bearing member;

a first developing device for developing the first electrostatic image on the image bearing member with a first toner, and a second developing device for developing the second electrostatic image on the image bearing member bearing the first toner image thereon with a second toner, the second developing device having a toner carrying member opposed to the image bearing member and carrying the toner thereon;

the force with which the first toner, having mixed into said second developing device is carried on said toner carrying member being smaller than that of the second toner.

Further objects of the present invention will become apparent from the following detailed description.

DESCRIPTION OF THE PREFERRED EMBODIMENTS

Figure 1:
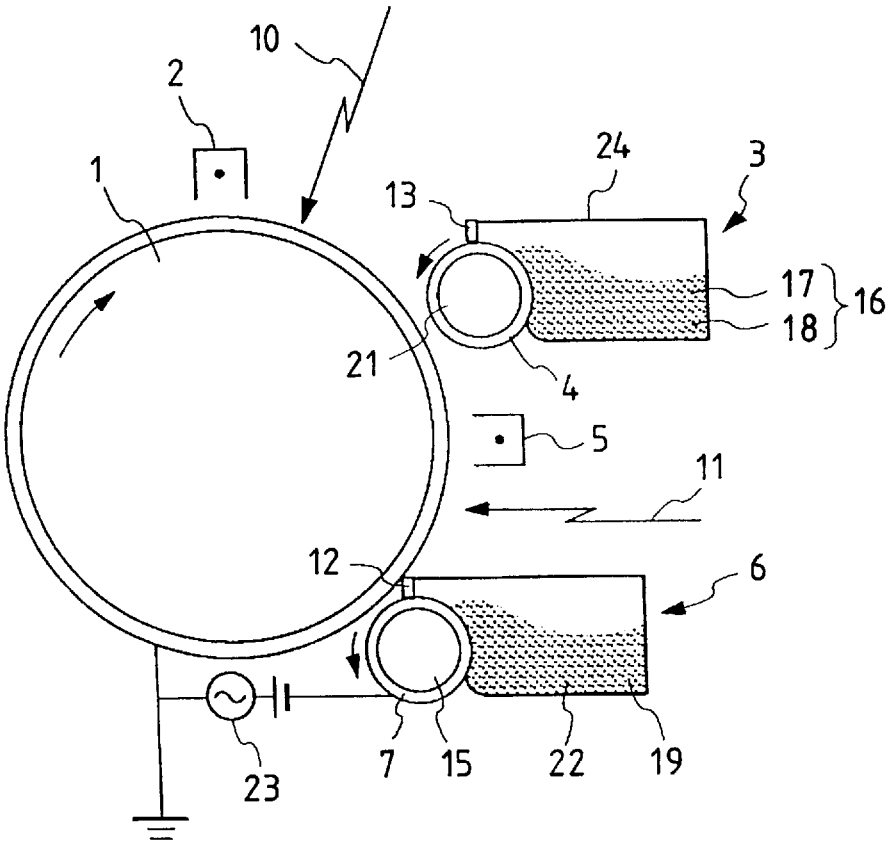
FIG. 1 schematically shows the construction of a two-color image forming apparatus by which a two-color multiplex developing method according to the present invention is carried out.
Figure 2:
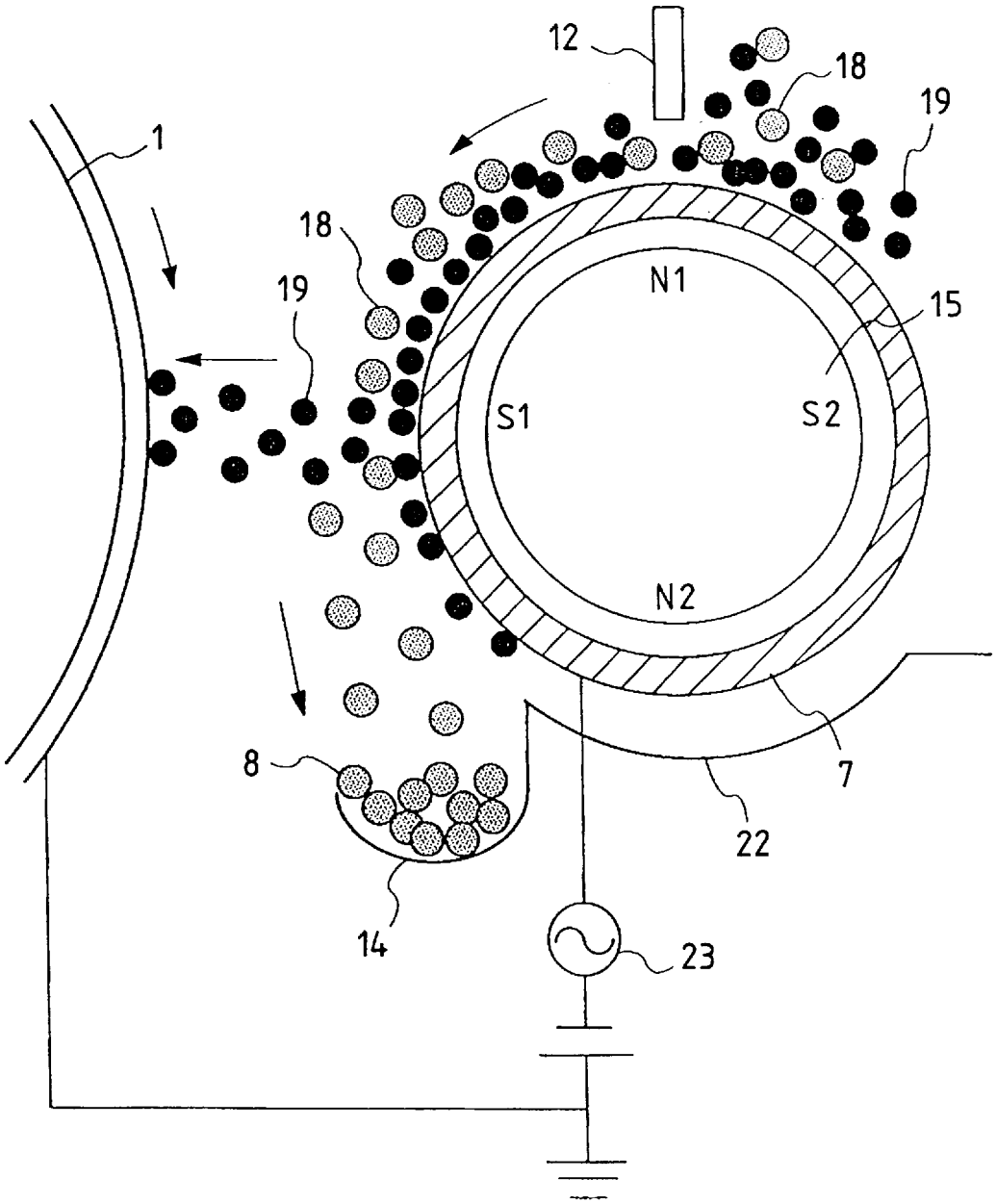
FIG. 2 is a cross-sectional view showing the developing area of a second developing device, installed in the image forming apparatus of FIG. 1.

FIG. 1 schematically shows the construction of a two-color image forming apparatus by which a two-color multiplex developing method according to the present invention is carried out, and FIG. 2 is a cross-sectional view showing the developing area of a second developing device installed in the image forming apparatus of FIG. 1.

This two-color image forming apparatus, as shown in FIG. 1, is provided with an electrophotographic photosensitive drum (photosensitive medium) 1 which is a latent image forming medium, and around it, a first charger 2, a first exposure device (not shown) for effecting first exposure 10, a first developing device 3, a second charger (re-charger) 5 and a second exposure device (not shown) for effecting second exposure 11.

The two-color image forming apparatus uniformly charges the surface of the photosensitive drum 1 by the charger 2, whereafter it effects the first exposure 10 to thereby form a first latent image, and develops the first latent image by the first developing device 3 by the use of a non-magnetic first toner 18 to thereby form a first toner image, and then again uniformly charge the surface of the photosensitive drum by the charger (re-charger) 5, whereafter it effects the second exposure to thereby form a second latent image, and develops the second latent image by the second charger 6 by the use of a second toner 19 differing in color from the first toner 18 to thereby form a second toner image. As a result, a two-color image by the two-color multiplex developing method is obtained on the photosensitive drum 1.

Thereafter, the two-color image on the photosensitive drum 1 is collectively transferred onto transfer paper by a transfer charger, not shown, whereafter the transfer paper is conveyed to a fixating device, by which the fixation of the toner image of two colors is effected, whereby a color print of two colors is provided. Thus, all steps of the two-color image formation by the two-color multiplex developing method are terminated, and the color print of two colors is discharged out of the image forming apparatus.

In the above-described two-color multiplex developing method, when the second toner 19 developing the second latent image comes into contact with the first toner image and strips off the first toner 18, the mixing of the first toner 18 into the second developing device 6 occurs. A magnetic one-component non-contact jumping developing method, i.e., a magnetic one-component non-contact alternate electric field developing method, is best suited for the prevention of the mixing of the first toner 18 into the second developing device 6 and the efficient collection of the first toner 18 having mixed into the second developing device 6.

That is, the second developing device 6 uses as the second toner, a magnetic toner containing a magnetic material, and forms a toner layer smaller than a developing gap (the gap between the photosensitive drum and a developing sleeve) on the developing sleeve.

An alternating electric field is then formed between the photosensitive drum and the developing sleeve and the toner on the developing sleeve is made to fly toward the photosensitive drum.

The second developing device 6, as shown in FIGS. 1 and 2, is provided with a developer container 22 containing therein a magnetic toner as the second toner 19, and has a developing sleeve 7 rotatable in the direction of arrow in the opening portion of this developer container 22 which faces the photosensitive drum 1. A roller-like magnet 15 is disposed against rotation in the developing sleeve 7, and above the developing sleeve 7, there is, disposed a magnetic blade 12 which is a toner regulating member with a small gap provided therebetween. This magnetic blade 12 is opposed to one magnetic pole N1 of a magnet 15. A bias voltage source 23 is connected between the developing sleeve 7 and the photosensitive drum 1, and during development, an alternate voltage, comprising a DC voltage superposed on an AC voltage is applied.

In the present invention, when the first toner 18 has mixed into the second developing device 6, the carrying force for the first toner 18 by the developing sleeve 7 of the second developing device 6 is weakened so that the first toner 18 can be discharged out of the second developing device 6 and collected. In order to thus make the carrying force for the first toner weaker than that for the second toner, in the present embodiment, the average particle diameter of the first toner 18 is made larger than the average particle diameter of the second toner 19.

According to the present invention, even if the first toner 18 mixes into the second developing device 6, the first toner 18, having mixed into the second developing device 6, can be separated and discharged out of the second developing device 6 without being accumulated in the second developing device 6 and thus, the influence of the first toner on the second toner image can be eliminated, and also the development of the second toner image by the second toner itself can be effected well. The reason is considered as follows.

As described above, the average particle diameter of the first toner 18 is made larger than the average particle diameter of the second toner 19, but the amount of charge per unit area of a toner gained by friction becomes smaller as the average particle diameter of the toner becomes larger. Accordingly, when the first toner 18 has mixed into the second developing device 6, the first toner 18, larger in the particle diameter, becomes smaller in the amount of charge by the reduction in the amount of charge by the friction in the second developing device 6 than the second toner 19 which is smaller in the particle diameter. That is, the first toner 18 mixing into the second developing device 6 adheres to the developing sleeve of the second developing device 6 in a second developing area and goes on mixing into the second developing device 6 with the rotational motion of the developing sleeve, whereafter it mixes with the second toner 19, smaller in the particle diameter, but as compared with the second toner smaller in the particle diameter, the first toner, larger in the particle diameter, is interior in the chargeability per unit area by the frictional contact with the developing sleeve, and loses its charges while there are few chances for contacting the developing sleeve densely coated with the second toner, originally smaller in the particle diameter.

Therefore, a reflection force of the toner relative to the developing sleeve 7, in other words, a toner carrying force by the developing sleeve 7 is relatively stronger for the second toner 19 than the first toner 18, and when the first toner 18 and the second toner 19 pass between the magnetic blade 12 and the developing sleeve 7, the second toner 19 is selectively applied onto the developing sleeve 7. Further, the second toner 19 is greater in the average amount of charge and therefore, in the developing area, the second toner 19 adheres onto the photosensitive drum 1 and the developing sleeve 7 in such a manner as to be selectively screened by the AC part of the alternate bias of second developing. Accordingly, the second developing of the second latent image on the photosensitive drum 1 by the second toner 19 itself is effected well and a normal second toner image is obtained.

On the other hand, the first toner 18, larger in the average particle diameter and relatively small in the amount of charge, is not applied onto the developing sleeve 7 when it passes between the magnetic blade 12 and the developing sleeve 7, because the toner carrying force of the developing sleeve 7, based on the reflection force of the toner is weak, and the first toner 18 is moved in such a manner to accompany the selectively applied second toner 19. Since the average amount of charge of the first toner 18 is small, the first toner 18 is wafted between the developing sleeve 7 and the photosensitive drum 1 in the developing area by the AC bias part, and gradually becomes not maintained on the developing sleeve 7 and on the photosensitive drum 1 and falls to below the developing sleeve 7 outside the second developing device 6. That is, the first toner 18 is separated and discharged out of the second developing device 6 and is not accumulated in the second developing device 6. Thus, there is no influence of the first toner 18 on the second toner image.

In the present invention, means for separating and collecting the first toner 18, which has mixed into the second developing device 6, is further installed near the developing sleeve 7 of the second developing device 6. Accordingly to the present embodiment, this separating and collecting means is provided as a receiving dish 14 located below the gap portion in which the developing sleeve 7 and the photosensitive drum 1 are opposed to each other. This receiving dish 14 is mounted on the lower part of the opening portion of the container 22 of the second developing device 6. The first toner 18 discharged and, falling out of the second developing device 6, is received and collected by the receiving dish 14.

In the present embodiment, the first developing device 3 adopts the two-component magnetic brush developing method. The first developing device 3 contains, in a developer container 24, a two-component developer 16 composed of a non-magnetic toner (first toner) 18 and a magnetic carrier 17 mixed together. This developer 16 is carried on a developing sleeve 4 by the draw-up pole of a roller-like magnet 21 therein, is conveyed to the developing area opposed to the photosensitive drum 1 by the developing sleeve 4 being rotated, and in the course of the conveyance, the layer thickness of the developer 16 on the developing sleeve 4 is magnetically regulated by the magnetic blade 13 and the regulating pole of the magnet 21 and applied as a thin layer, and in the developing area, the thin layer of the developer 16 is formed into the form of a magnetic brush by the developing pole of the magnet 21. An alternate electric field is then produced in the developing area by an alternate bias applied to the developing sleeve 4, whereby the first toner 18 in the developer 16 on the developing sleeve 4 is made to fly to the photosensitive drum 1 to thereby develop the first latent image on the photosensitive drum 1 and make it visible as a toner image.

The present embodiment is constructed as described above, and adopts the magnetic one-component non-contact alternate electric field developing method for the second developing, and makes the average particle diameter of the first toner used in the first developing larger than the average particle diameter of the second toner used in the second developing, to thereby make the average amount of charge of the first toner smaller than the average amount of charge of the second toner after the mixing of the first toner into the second developing device. Accordingly, the toner carrying force by the developing sleeve, based on the reflection force of the toner, can be made weaker for the first toner, having mixed into the second developing device, than for the second toner, and the first toner, having mixed into the second developing device, can be separated and collected without being accumulated in the second developing device. Accordingly, the high quality of the first toner image on the photosensitive drum by the first toner can be maintained, while color mixing of the second toner image can be eliminated and a two-color image of a high quality can be obtained easily.

In the foregoing, the two-component magnetic brush developing method is adopted as the first developing by the first developing device 3, but in the present invention, the non-magnetic one-component developing method using a non-magnetic toner alone, and more particularly the non-magnetic one-component non-contact alternate electric field developing method can also be adopted as the first developing method.

In such case, the use of a method of regulating the non-magnetic toner by an elastic blade urged against the developing sleeve and making it into a thin layer for use in developing would be better as the first developing method. This is because when the non-magnetic toner is made into a thin layer on the developing sleeve by the elastic blade, the amount of charge can be made sufficiently high and accordingly, if this is used as the first toner, of which the amount of charge is made lower after the mixing into the second developing device 6, the first developing can be affected by the first toner in a state in which the amount of charge thereof is sufficient and as a result, the scattering and fogging of the toner during the first developing can be prevented and therefore, a high quality of the first toner image in terms thereof can be maintained. Also, because it becomes difficult for the stripping-off of the first toner image in the developing area of the second developing device to take place, the mixing of the first toner into the second developing device by the stripping-off can be decreased.

Also, in the present embodiment, the particle diameter of the first toner 18 is made larger than the particle diameter of the second toner 19 to thereby reduce the amount of charge of the first toner, having mixed into the second developing device, and weaken the carrying force for the first toner by the developing sleeve, but if the binder species and/or the extraneous additive species of the first and second toners are adjusted and their positions on the frictional charging series are set more toward the opposite polarity in the order of the second toner and the first toner, the amount of charge of the first toner 18 can be reduced by the friction after the mixing thereof into the second developing device 6. Accordingly, the carrying force of the developing sleeve 7 for the first toner 18, having mixed into the second developing device, can be weakened and the first toner 18 can be separated and collected from the second developing device 6.

A specific example of the present embodiment will be shown below.

Two-color image formation was effected by the two-color multiplex developing method by the use of the image forming apparatus of FIG. 1. The first developing device 3 was replaced by a one-component developing device, not shown, and the first developing was done by the non-magnetic one-component developing method. The second developing by the second developing device 6 is the magnetic one-component non-contact developing method.

The details of conditions such as the first toner and the second toner used in the first developing and the second developing are as follows.

First Developing first toner: non-magnetic toner, red
binder resin: polyester
extraneous additive: silica 0.5 part by weight
average particle diameter: 8.5 $\mu$m developing method: non-magnetic one-component non-contact alternate electric field developing method elastic blade: elastic rubber blade Second Developing second toner: magnetic toner, black
binder resin: polyester
extraneous additive: silica 1.0 part by weight
average particle diameter: 6.0 $\mu$m developing method: magnetic one-component non-contact alternate electric field developing method The above-mentioned conditions were used in the first developing and the second developing of 10,000 sheets to effect two-color image formation by the two-color multiplex developing method. As a result, color mixing by the mixing of the first toner was not found in the two-color image obtained, and about 30 mg of the first toner having mixed into the second developing device 6 was collected in the receiving dish 14 below the second developing device 6.

Also, the average amount of charge of the first toner, which was −20 to −40 $\mu$C/g on the developing sleeve of the first developing device, was nearly 0 $\mu$C/g during the collection. The average amount of charge of the second toner exhibited no change before and after the mixing of the first toner, and was about −10 to −20 $\mu$C/g.

COMPARATIVE EXAMPLE 1

A magnetic toner having an average particle diameter of 9.0 $\mu$m was used as the second toner. In the other aspects, the conditions were the same as in Embodiment 1 and two-color image formation was effected.

As a result, at a point in time at which about image formation on 100 sheets was effected, the first toner (red toner), having mixed into the second developing device, adhered onto the developing sleeve of the second developing device. When at this time, image formation of a single color, black, was done, the black image was reproduced with a reddish tinge by the first toner having mixed into the second developing device.

Embodiment 2

Figure 3:
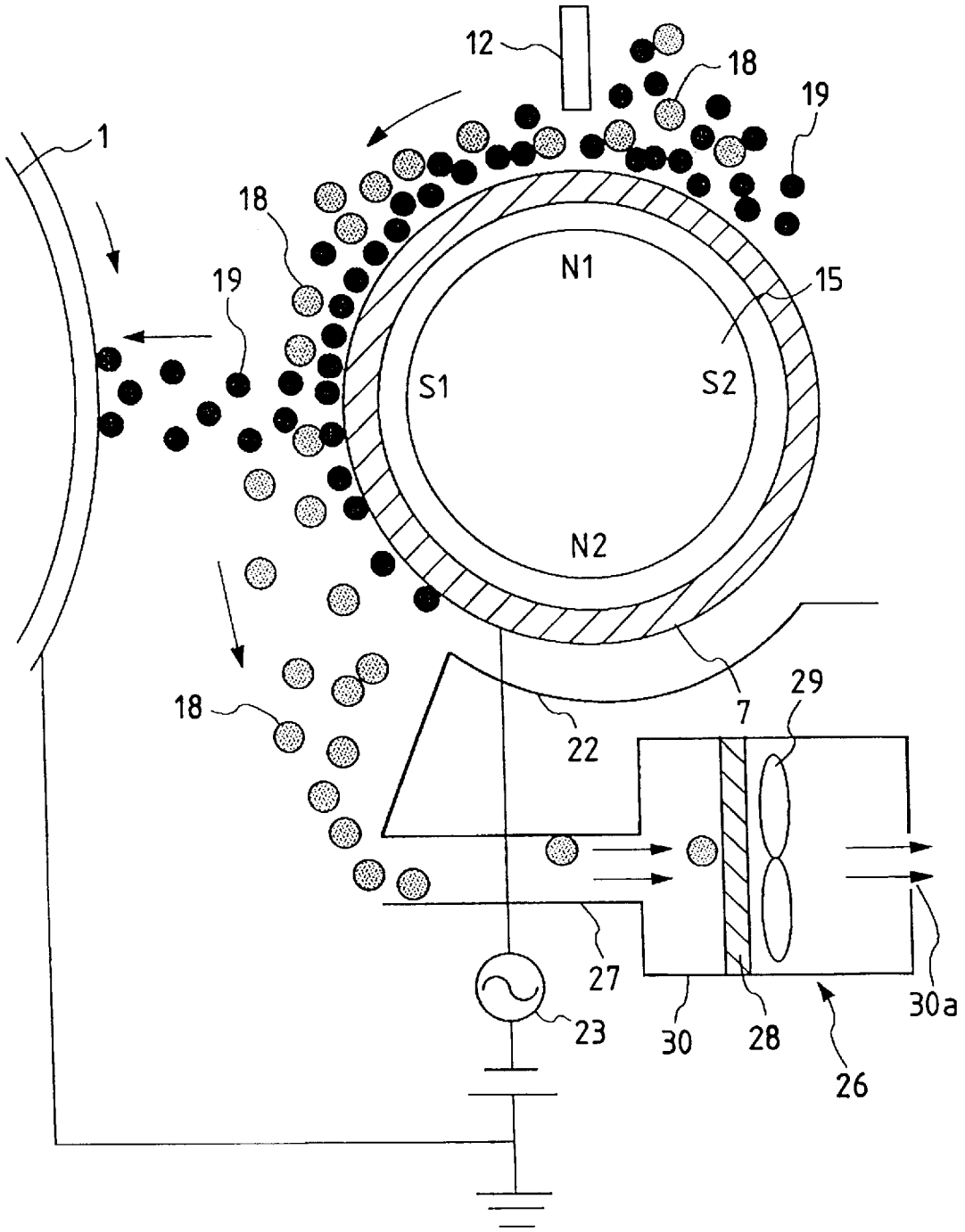
FIG. 3 is a cross-sectional view showing the essential portions of a second developing device having installed therein an air dust collector used in another embodiment of the present invention.

In this embodiment, in Embodiment 1, the first developing device 3 was used in the first developing, and the first developing was done by the two-component magnetic brush developing method. In the second developing device 6 effecting the second developing, as shown in FIG. 3, an air dust collector 26 was installed as the separating and collecting means. In other aspects, the construction of the present embodiment is basically similar to that of Embodiment 1.

The air dust collector 26 comprises a fan 29 contained in a duct 30 and a filter 28 contained in the duct 30 and disposed forwardly thereof, and an opening portion 27 provided on the filter 28 side of the duct 30, and the opening portion 27 is made to face a position below the gap portion in which the developing sleeve 7 and the photosensitive drum 1 are opposed to each other.

When the fan 29 is rotated to discharge the air in the duct 30 through an exhaust port 30*a*, there is created a suction force which makes the air flow from the gap portion between the developing sleeve 7 and the photosensitive drum 1 through the opening portion 27 to the interior of the duct 30.

In the present embodiment, as described above, the first developing is effected by the two-component magnetic brush developing method, and the non-magnetic toner is used in a form mixed with a carrier. According to the present embodiment, the non-magnetic toner, i.e., the first toner, used in the first developing, as in the case of Embodiment 1, has its average particle diameter made larger than that of the second toner, and after having mixed into the second developing device 6, the average amount of charge of the first toner becomes smaller than that of the second toner, so that the carrying force for the first toner by the developing sleeve may become weak.

Therefore, even when the first toner mixes into the second developing device 6, as shown in FIG. 3, the first toner 18 is separated and discharged out of the second developing device 6 in a manner similar to the case of Embodiment 1, and falls below the developing sleeve 7. Accordingly, the first toner 18 is not accumulated in the second developing device 6 and the influence of the first toner 18 on the second toner image is null. Also, if the first toner is sucked by the air dust collector 26, it will be collected into the duct 30.

The details of the first developing and the second developing in the present embodiment are as follows.

First Developing first toner: non-magnetic toner, red
binder resin: polyester
extraneous additive: silica 0.5 part by weight
average particle diameter: 8.5 $\mu$m carrier: fluorine and acryl-coated ferrite magnetic particles
average particle diameter: 55 $\mu$m mixing ratio of toner and carrier: 10% developing method: two-component magnetic brush developing method

Second Developing second toner: magnetic toner, black
binder resin: polyester
extraneous additive: silica 1.0 part by weight
average particle diameter: 6.0 $\mu$m developing method: magnetic one-component non-contact alternate electric field developing method In the present embodiment, the above-mentioned conditions were used in the first developing and the second developing, and 10,000 sheets of two-color image formation was effected by the two-color multiplex developing method. As a result, color mixing by the mixing of the first toner was not found in the two-color image obtained, and about 30 mg of the first toner having mixed into the second developing device 6 was collected in the dust collector 26 below the second developing device 6.

Embodiment 3

Figure 5A:
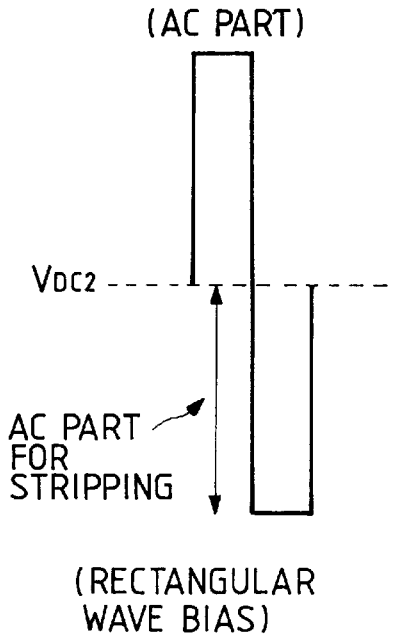
FIGS. 5A and 5B show a developing bias used in yet still another embodiment of the present invention and a developing bias according to the prior art.
Figure 5B:
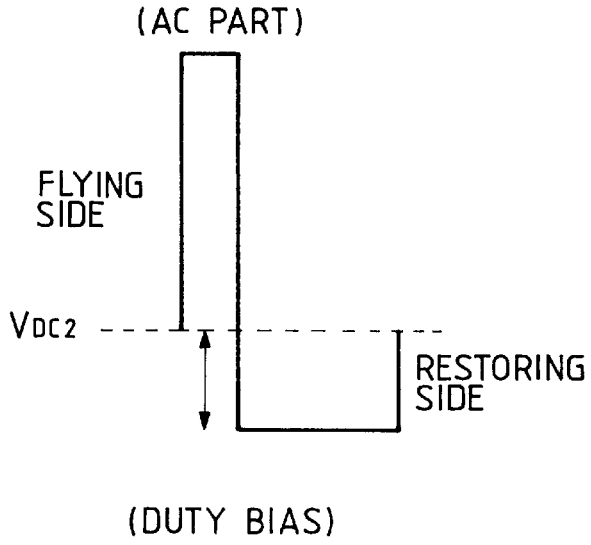

In this embodiment, in Embodiment 1, a binder of the styrene acryl line was used as the binder resin of the first toner 18, and the position on the frictional charging series of the first toner 18 was brought more toward the opposite polarity than the second toner 19 using the binder resin of the polyester line. Also, as shown in FIGS. 5A and 5B, an electric dust collector 32 was installed as the separating and collecting means in the second developing device 6 effecting the second developing. In the other aspects, the construction of the present embodiment is basically similar to that of Embodiment 1.

The electric dust collector 32 comprises an electrode roller 33 to which a DC power source 36 is connected, and a duct 34 containing it therein. The duct 34 has an opening portion at a location below the gap portion in which the developing sleeve 7 and the photosensitive drum 1 are opposed to each other, and the electrode roller 33 is disposed in the opening portion. In order to electrically attract and collect the first toner 8 separated and discharged out of the second developing device 6 and falling to below the developing sleeve 7, a DC voltage of e.g. the order of −1000 V is applied to the electrode roller 33, whereby the first toner 8, attracted and adhering to the electrode roller 33, is removed by a scraper 35 bearing against the electrode roller 33.

In the present embodiment, as described above, the position on the frictional charging series of the first toner is more toward the opposite polarity than that of the second toner and therefore, after having mixed into the second developing device 6, the first toner frictionally contacts the second toner, whereby the average amount of charge of the first toner is liable to become smaller than the average amount of charge of the second toner. Accordingly, the effect of the first toner 8 being separated and discharged out of the second developing device 6 is improved. Also, by combining it with the electric dust collected by the electrode roller 33, the collection efficiency of the first toner is also improved.

The details of the first developing and the second developing in the present embodiment are as follows.

First Developing first toner: non-magnetic toner, red
binder resin: styrene acryl
extraneous additive: silica 0.5 part by weight
average particle diameter: 9.0 $\mu$m developing method: non-magnetic one-component non-contact alternate electric field developing method elastic blade: elastic rubber blade Second Developing Second toner: magnetic toner, black
binder resin: polyester
extraneous additive: silica 0.6 part by weight
average particle diameter: 9.0 $\mu$m developing method: magnetic one-component non-contact alternate electric field developing method In the present embodiment, by the above-described construction, two-color image formation was effected on 10,000 sheets in the manner described in Embodiment 1. As a result, color mixing by the mixing of the first toner was not found in the obtained two-color image, and the first toner having mixed into the second developing device 6 was collected on the electrode roller 33 below the second developing device 6.

The average amount of charge of the collected first toner, which was −20 to −35 $\mu$C/g on the developing sleeve of the first developing device, became nearly 0 $\mu$C/g. The average amount of charge of the second toner did not change before and after the mixing of the first toner, namely, was of the order of −10 to −20 $\mu$C/g.

In the present embodiment, as described above, the kinds of the binder resin in the toners were changed to control the positional relation between the first toner and the second toner on the friction charging series, but alternatively, the kinds of a charging control agent, wax and the extraneous additive may be changed for control.

Embodiment 4

This embodiment uses a duty bias shown in FIG. 5B as the developing bias used for the second developing by the second developing device 6 in Embodiment 1. In other aspects, the present embodiment is similar to Embodiment 1. This duty bias, as compared with a rectangular wave bias shown in FIG. 5A, is one in which the lower peak voltage value is made small and the application time is made long.

According to the above-described duty bias, the alternate electric field formed between the photosensitive drum 1 and the developing sleeve 7 of the second developing device 6 is greater in its peak value in a direction to move the toner from the developing sleeve 7 to the photosensitive drum 1 side than in its peak value in a direction to draw the toner from the photosensitive drum 1 back to the developing sleeve 7 side. Thus, according to the present embodiment, the possibility itself of the first toner 18 mixing into the second developing device 6 can be considerably mitigated.

Embodiment 5

Figure 7:
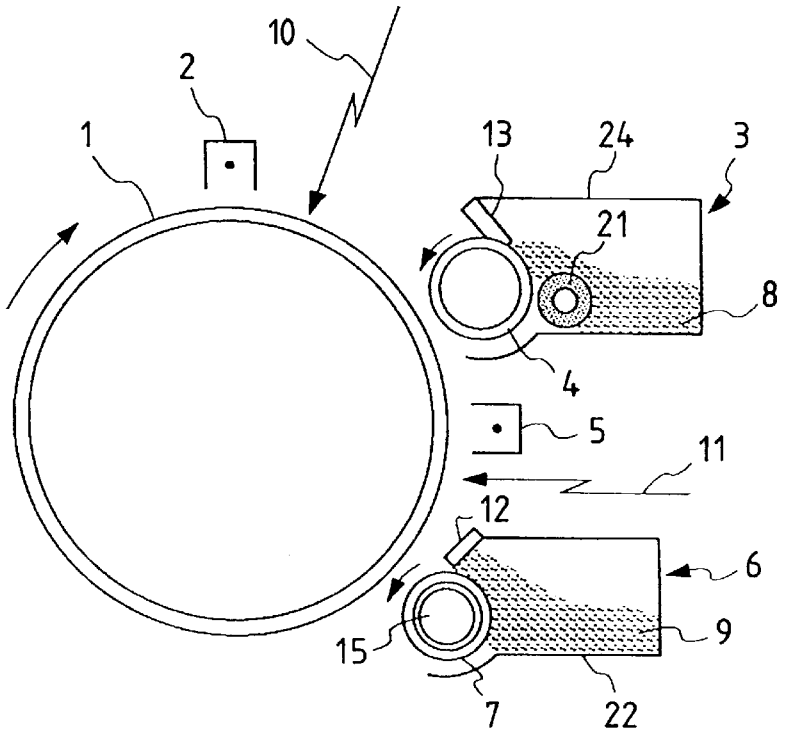
FIG. 7 schematically shows the construction of an image forming apparatus according to another embodiment of the present invention.
Figure 6:
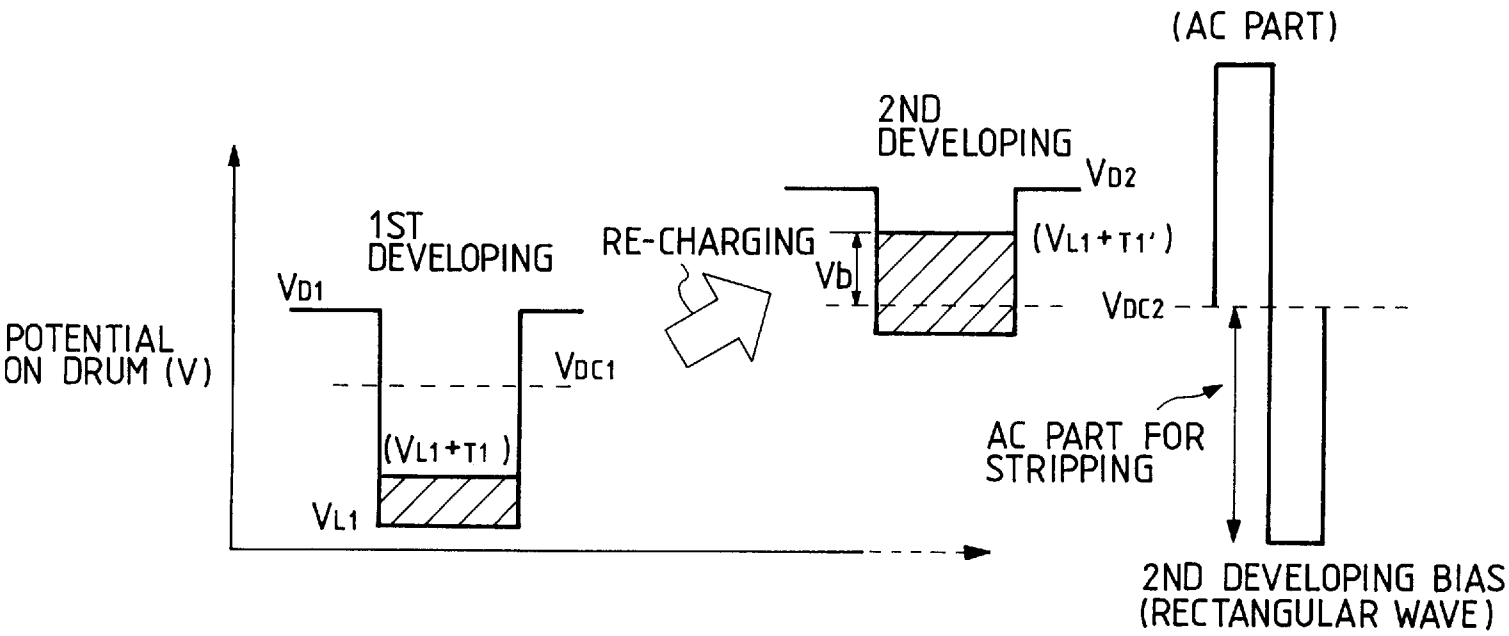
FIG. 6 shows the change of the charging potential on the surface of a photosensitive drum when the photosensitive drum is uniformly negatively charged exposed, and developed by the two-color multiplex developing method.

FIG. 7 schematically shows the construction of an image forming apparatus according to another embodiment of the present invention.

Figure 8:
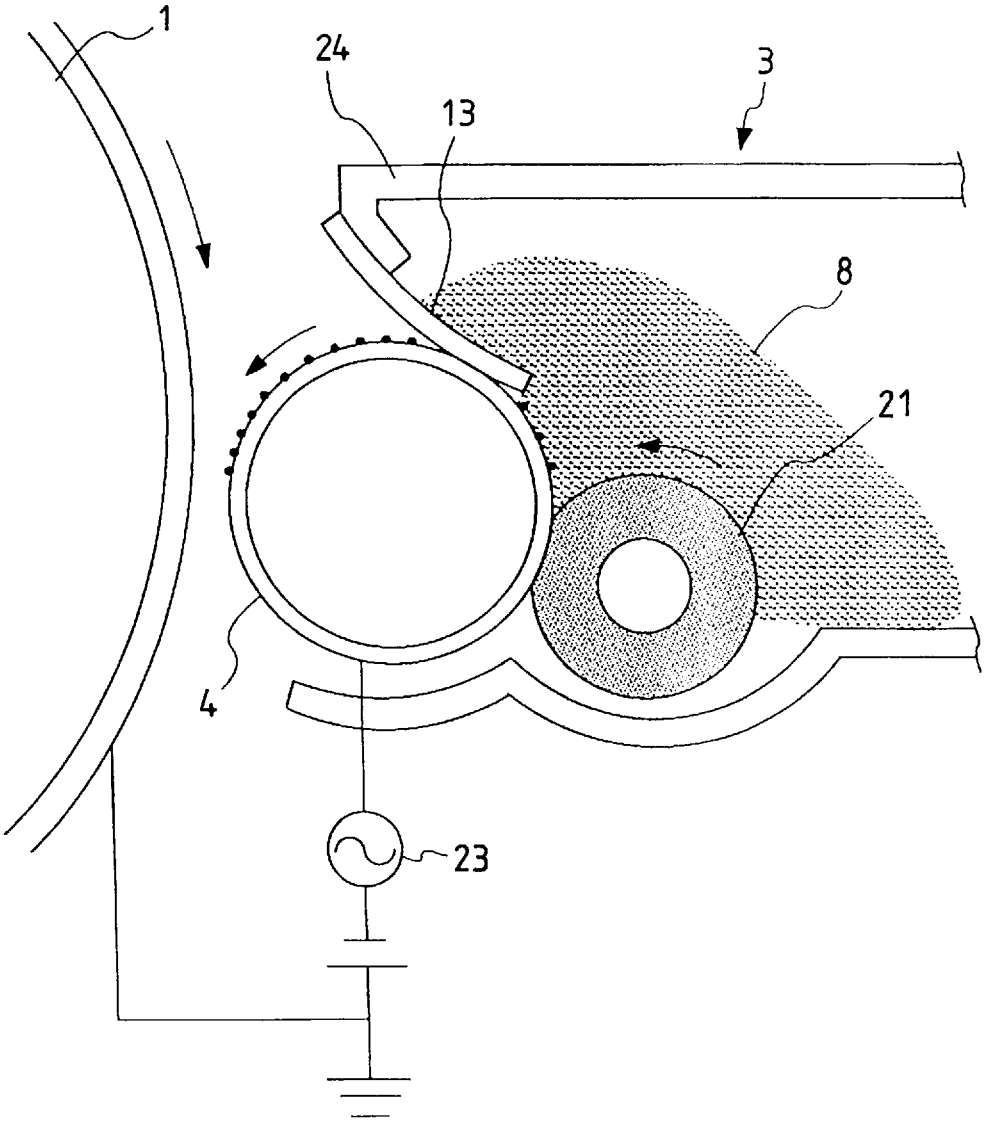
FIG. 8 is a cross-sectional view showing the essential portions of a first developing device installed in the image forming apparatus of FIG. 7.

The construction of the second developing device 6 is similar to that shown in FIG. 2, and FIG. 8 is an enlarged view of the first developing device 3.

This two-color image forming apparatus, as shown in FIG. 7, is comprised of an electrophotographic photosensitive drum (photosensitive medium) 1 which is a latent image forming medium, and around it, are a first charger 2, a first exposure device (not shown) for effecting first exposure 10, a first developing device 3, a second charger (re-charger) 5 and a second exposure device (not shown) for effecting second exposure 11.

The two-color image forming apparatus uniformly charges the surface of the photosensitive drum 1 by the charger 2, whereafter it effects the first exposure 10 to thereby form a first latent image, and develops the first latent image by the first developing device 3 by the use of a first toner 8, having a color, to thereby form a first toner image, and then again uniformly charges the surface of the photosensitive drum 1 by the second charger (recharger) 5, whereafter it effects the second exposure 11 to thereby form a second latent image, and develops the second latent image by the second developing device 6 by the use of a second toner 9, differing in color from the toner 8, to thereby form a second toner image. As a result a two-color image by the two-color multiplex developing method is obtained on the photosensitive drum 1.

Thereafter, the two-color image on the photosensitive drum 1 is collectively transferred onto transfer paper by a transfer charger, not shown, whereafter the transfer paper is conveyed to a fixating device, by which the fixation of the two-color toner image is effected, and it is provided as a two-color print. Thus, all steps of the two-color image formation by the two-color multiplex developing method are terminated, and the two-color print is discharged out of the image forming apparatus.

In the above-described two-color multiplex developing method, the magnetic one-component non-contact jumping developing method, i.e., the magnetic one-component non-contact alternate electric field developing method, is adopted in the second developing device 6 so that the second toner 9 developing the second latent image may not disturb the first toner image and that, as will be described later, even if the first toner 8 mixes into the second developing device 6, it can be efficiently discharged.

This second developing device 6, as shown in FIGS. 7 and 8, is provided with a developer container 22 containing therein a magnetic toner as the second toner 9, and has a developing sleeve 7 rotatable in the direction of arrow in the opening portion of the developer container 22 which is opposed to the photosensitive drum 1. A roller-like magnet 15 is disposed against rotation in the developing sleeve 7, and above the developing sleeve 7, a magnetic blade 12, which is a toner regulating member, is disposed with a small gap therebetween. This magnetic blade 12 is opposed to one magnetic pole N1 of the magnet 15. A bias voltage source 23 is connected between the developing sleeve 7 and the photosensitive drum 1, and during development, an alternate voltage comprising a DC voltage superposed on an AC voltage is applied as a developing bias.

Also, in the present embodiment, when the first toner 8 has mixed into the second developing device 6, in order to weaken the carrying force for the first toner 8 by the developing sleeve 7 of the second developing device 6, to discharge the first toner 8 out of the second developing device 6 and to collect it, the design of the device is made such that the average amount of charge per unit mass of the first toner 8, having mixed into the second developing device 6, becomes smaller than the average amount of charge per unit mass of the second toner 9.

To make the average amount of charge of the first toner 8, after having mixed into the second developing device 6, smaller than the average amount of charge of the second toner 9, the kinds of binder resins used in the first toner 8 and the second toner 9 can be made to differ from each other, or the kinds and amounts of addition of charging control agents and extraneous additives used in these toners can be made to differ from each other to thereby bring the position on the frictional charging series of the first toner 8 more toward the opposite polarity than the second toner 9. If the control of such position on the frictional charging series is done, the first toner 8 rubs against the second toner 9 in the second developing device 6, whereby the amount of charge possessed by the first toner 8 is gradually lost and reduced and therefore, the average amount of charge of the first toner 8, after having mixed into the second developing device, can be made smaller than the average amount of charge of the second toner 9.

As other means, it is also possible to make the average particle diameter of the first toner 8 larger than the average particle diameter of the second toner 9 to thereby reduce the average amount of charge per unit weight of the first toner 8 and weaken the carrying force of the toner carrying member for the first toner 8 after having mixed into the second developing device 6.

Further, in the present embodiment, means for separating and collecting the first toner 8, having mixed into the second developing device 6, is installed near the toner carrying member of the second developing device 6, and according to the present embodiment, this separating and collecting means is in the form of a receiving dish 14 located below the gap portion in which the developing sleeve 7 and the photosensitive drum 1 are opposed to each other. This receiving dish 14 is mounted below the opening portion of the container 22 of the second developing device 6.

According to the present embodiment, even if the first toner 8 mixes into the second developing device 6, the first toner 8, having mixed into the second developing device, can be separated and discharged out of the second developing device 6 without being accumulated therein, to thereby eliminate the influence of the first toner 8 on the second toner image, and the development of the second toner image by the second toner itself can also be effected well. The reason for this is considered to be as follows.

As described above, when the first toner 8 mixes into the second developing device 6, the average amount of charge of the first toner 8 becomes smaller than the average amount of charge of the second toner 9. Therefore, the reflection force of the second toner 9 to the developing sleeve 7 is relatively stronger than that of the first toner 8, and when the first toner 8 and the second toner 9 pass between the magnetic blade 12 and the developing sleeve 7, the second toner 9 is selectively applied onto the developing sleeve 7.

Further, the second toner 9 is greater in the average amount of charge and therefore, in the developing area, the second toner 9 adheres to the photosensitive drum 1 and the developing sleeve 7 in such a manner as to be selectively screened by the AC part of the alternate bias of the second developing. Accordingly, the second developing of the second latent image on the photosensitive drum 1 by the second toner 9 itself is effected well and a normal second toner image is obtained.

On the other hand, the first toner 8 smaller in the average amount of charge, experiences a weak reflection force to the developing sleeve 7 and therefore, when it passes between the magnetic blade 12 and the developing sleeve 7, the first toner 8 is not applied to the surface of the developing sleeve 7, but is moved in such a manner as to mechanically weakly adhere to the selectively applied second toner 9. Since the average amount of charge of the first toner 8 is small, the first toner 8 wafts between the developing sleeve 7 and the photosensitive drum 1 in the developing area due to the AC bias part and gradually becomes not maintained on the developing sleeve 7 and on the photosensitive drum 1, and falls below the developing sleeve 7 outside the second developing device 6. That is, the first toner 8 is separated and discharged out of the second developing device 6 and is not accumulated in the second developing device 6. Also, the influence of the first toner 8 on the second toner image is null.

The first toner 8, which has been discharged out of the second developing device 6 and has fallen, is received by and collected in the receiving dish 14.

In the present embodiment, it is also possible to adopt in the first developing by the first developing device 3 the two-component developing method using a two-component developer composed of a mixture of a non-magnetic toner and a magnetic carrier, but the non-magnetic one-component non-contact AC developing method using a non-magnetic toner alone is suitable.

The essential portions of the first developing device used in the present embodiment is shown in FIG. 8. This first developing device 3 executes the first developing by the non-magnetic one-component non-contact developing method.

The first developing device 3 has a developer container 24 containing therein a non-magnetic toner as the first toner 8, and a developing sleeve 4 is disposed in the opening portion of the container 24 which faces the photosensitive drum 1. Because the first toner 8, which is a non-magnetic toner, is used, a magnet is not contained in this developing sleeve 4, but instead, there is disposed an elastic roller 7 elastically bearing against that portion of the developing sleeve 4 which is opposite to the photosensitive drum 1. This elastic roller 7 is rotated so as to be opposite in direction to the developing sleeve 4 in its bearing portion to thereby strip off any remaining toner on the developing sleeve 4 and also to rub fresh toner 8 against the developing sleeve 4 and cause the fresh toner 8 to be carried on the developing sleeve 4.

Substantially above the developing sleeve 4, there is provided an elastic blade 13 elastically bearing against it. The first toner 8 carried on the developing sleeve 4 is conveyed to the location at which the elastic blade 13 is disposed, with the rotation of the developing sleeve 4, and is regulated by the elastic blade 13. Thereby, the toner 8 carried on the developing sleeve 4 has charges imparted thereto and is formed into a thin layer on the developing sleeve 4.

The developing sleeve 4 is disposed in non-contact with the photosensitive drum 1 with a small gap therebetween in the developing area opposed to the photosensitive drum 1, as in the case of the second developing device 6. A bias voltage source 25 is connected between the developing sleeve 4 and the photosensitive drum 1, and during development, an alternate bias comprising a DC voltage superposed on an AC voltage is likewise applied as a developing bias to the developing sleeve 4. By the application of this developing bias, an improvement in harmony and higher density are achieved.

In the non-magnetic one-component non-contact developing method as described above, a non-magnetic toner is used as the first toner 8 and therefore, the first toner 8 is easy to separate from the second developing device 6 and is correspondingly easy to collect in the receiving dish 14 due to the fact that the magnetic restraining force of the first toner 8 onto the developing sleeve 7 by the magnet 15 is null when the first toner 8 has mixed into the second developing device 6. Accordingly, this is advantageous to prevent the first toner 8 from being accumulated in the second developing device 6 and from affecting the two-color image obtained.

A specific example of the present embodiment will be shown below.

The image forming apparatus of FIG. 7 was used to effect two-color image formation by the two-color multiplex developing method. The first developing device 3 of FIG. 3 was used in the first developing, and the second developing device 6 of FIG. 2 was used in the second developing.

The details of conditions, such as the first toner and the second toner used in the first developing and the second developing, are as follows.

First Developing

- first toner: non-magnetic toner, red
  - binder resin: polyester
  - extraneous additive: dry type silica 0.5 part by weight
  - average particle diameter: 8.5 $\mu$m
  - average amount of charge after mixing: −5.8 $\mu$C/g
- developing method: non-magnetic one-component non-contact alternate electric field developing method
- elastic blade: nylon-coated urethane rubber blade
  - bearing pressure: 10 g/cm (line pressure)

Second Developing

- second toner: magnetic toner, black
  - binder resin: polyester
  - extraneous additive: oil-treated silica 1.0 part by weight
  - average particle diameter: 7.0 $\mu$m
  - average amount of charge: −10.5 $\mu$C/g
- developing method: magnetic one-component non-contact alternate electric field developing method In the present embodiment, the particle diameter of the first toner is made larger than the particle diameter of the second toner, and the chargeability of silica as the extraneous additive is set to a higher level in the second toner. Under these conditions, two-color image formation on 10,000 sheets was effected by the two-color multiplex developing method.

As a result, the color mixing by the mixing of the first toner was not found in the obtained two-color image, and about 30 mg of the first toner, having mixed into the second developing device 6, was collected in the receiving dish 14 below the second developing device 6.

Also, considering that the average amount of charge of the collected first toner was nearly 0 $\mu$C/g and the average amount of charge of the first toner when it mixed into the second developing device was about −5.8 $\mu$C/g on the developing sleeve, it is seen that the first toner, having mixed into the second developing device, frictionally contacts with the second toner, whereby the amount of charge of the first toner was gradually lost and reduced with time.

COMPARATIVE EXAMPLE 2

A magnetic toner having an average amount of charge of −3.3 μC/g (average particle diameter: 12 μm) was used as the second toner and two-color image formation was done in the same manner as in Embodiment 1 in the other aspects.

As a result, at a point in time at which image formation was effected on about 100 sheets, the first toner, having mixed into the second developing device, adhered to the developing sleeve of the second developing device. When at this time, the image formation of a single color, black, was done, the black image was reproduced with a reddish tinge by the first toner having mixed into the second developing device.

Embodiment 6

In this embodiment, the first developing device 3 in Embodiment 1 was replaced by a two-component developing device, not shown, and the first developing was effected by the two-component magnetic brush developing method. Also, in the second developing device 6 for effecting the second developing, as in FIG. 3, an air dust collector 26 was installed as the separating and collecting means. In other aspects, the construction of the present embodiment is basically similar to that of Embodiment 1.

The air dust collector 26 comprises a fan 29 contained in a box 30, a filter 28 contained in the box 30 and disposed forwardly thereof, and a duct 27 mounted on the filter 28 side of the box 30. The duct 27 has its end opening portion facing a location below the gap portion in which the developing sleeve 7 and the photosensitive drum 1 are opposed to each other, and the space between the fore end of the duct 27 and the lower portion of the developer container 22 is shut up by a suitable plate 31.

When the fan 29 is rotated to discharge the air in the box 30 from the exhaust port 30*a*, there is created a suction force which causes the air to flow through the duct 27 from the gap portion between the developing sleeve 7 and the photosensitive drum 1 and toward the interior of the box 30.

In the present embodiment, as described above, the first developing is effected by the two-component magnetic brush developing method and the non-magnetic toner is used in a form in which it is mixed with the carrier. According to the present embodiment, as in the case of Embodiment 1, the non-magnetic toner used in the first developing, i.e., the first toner, is such that the average amount of charge thereof, after having mixed into the second developing device 6, is smaller than the average amount of charge of the second toner.

Figure 12:
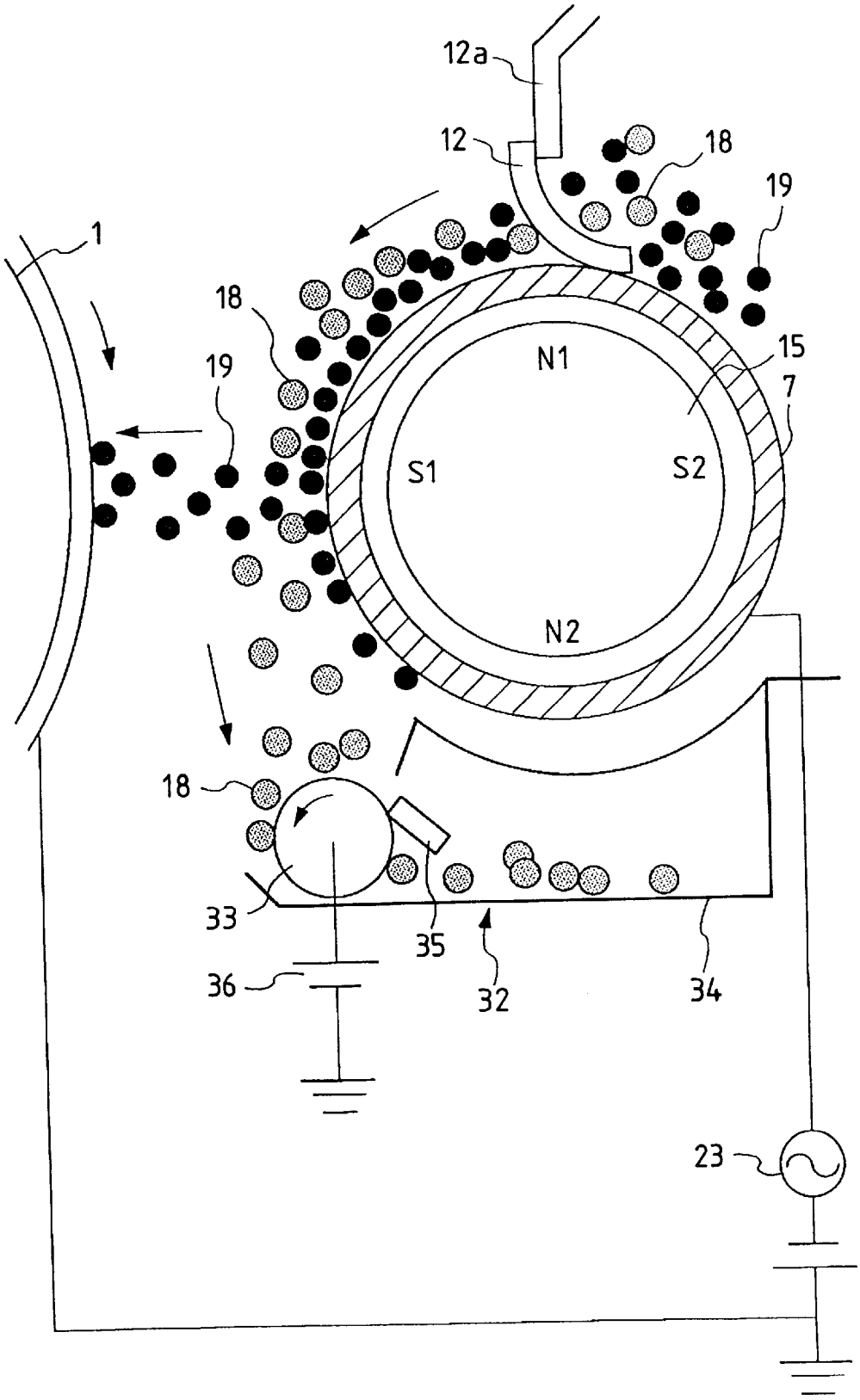
FIG. 12 is a cross-sectional view showing the essential portions of a second developing device having installed therein an electric dust collector used in still another embodiment of the present invention.

Therefore, even when the first toner mixes into the second developing device 6, as shown in FIG. 12, the first toner 8 is separated and discharged out of the second developing device 6 in the same manner as in Embodiment 1, and falls below the developing sleeve 7. Accordingly, the first toner 8 is not accumulated in the second developing device 6 and the influence of the first toner 8 on the second toner image is null. Also, if the first toner is sucked by the air dust collector 26, it will be collected into the box 30.

A specific example of the present embodiment will be shown below.

The details of conditions such as the first toner and carrier used in the first developing and the second toner, etc. used in the second developing are as follows. The present embodiment differs in the developing method of the first developing from Embodiment 1, and means for adjusting the average amount of charge of the toner, as in Embodiment 5, is the difference between the particle diameters of the toners and the chargeability of silica which is an extraneous additive.

First Developing

- first toner: non-magnetic toner, red
  - binder resin: polyester
  - extraneous additive: dry type silica 0.5 part by weight
  - average particle diameter: 8.5 μm
  - average amount of charge after mixing: −10.8 μC/g
- carrier: resin-coated ferrite magnetic particles
  - coat resin: fluorine and acryl resin
  - average particle diameter: 55 μm
- mixing ratio of toner and carrier: 10%
- developing method two-component magnetic brush developing method Second Developing

- second toner: magnetic toner, black
  - binder resin: polyester
  - extraneous additive: silica 1.0 part by weight
  - average particle diameter 6.0 μm
  - average amount of charge: −9.2 μC/g
- developing method: magnetic one-component non-contact alternate electric field developing method In the foregoing, when the amount of charge of the first toner on the developing sleeve was measured at the point in time after one minute's idle rotation of the second developing device into which the first toner mixed and the point in time after five minutes' idle rotation of the second developing device, it was confirmed that the amount of charge, which was −10.8 μC/g immediately after the mixing, sharply decreased to −4.2 μC/g and −0.3 μC/g, respectively. On the other hand, no change was found in the average amount of charge of the second toner after one minute's idle rotation and after five minutes' idle rotation, and it was found that the average amount of charge of the second toner was substantially the same as −9.2 μC/g at the beginning, i.e., −9.3 μC/g and −9.6 μC/g.

In the present embodiment in accordance with Embodiment 1, two-color image formation was effected on 10,000 sheets by the two-color multiplex developing method. As a result, color mixing by the mixing of the first toner into the second developing device was not found in the obtained two-color image, and about 30 mg of the first toner having mixed into the second developing device 6 was collected in the dust collector 26 below the second developing device 6.

Embodiment 7

In this embodiment, use was made of a first toner 8 in which the binder resin of the first toner 8 in Embodiment 1 was replaced by the binder resin of the styrene acryl line, and the position on the friction charging series of the first toner 8 was more toward the opposite polarity than the second toner 9 using the binder resin of the polyester line. Also, as in FIG. 4, in the second developing device 6 for effecting the second developing, an electric dust collector 32 was installed as the separating and collecting means. In other aspects, the construction of the present embodiment is basically similar to that of Embodiment 1.

The electric dust collector 32 comprises an electrode roller 33 to which a DC power source 36 is connected, and a box 34 containing it therein. The box 34 has an opening portion at a location below the gap portion in which the developing sleeve 7 and the photosensitive drum 1 are opposed to each other, and the electrode roller 33 is disposed in the opening portion. In order to electrically attract and collect the first toner 8 separated and discharged out of the second developing device 6 and falling to below the developing sleeve 7, a DC voltage of the order of e.g. 1000 V is applied to the electrode roller 33, whereby the first toner 8 attracted to and adhering to the electrode roller 33 is removed by a scraper 35 bearing against the electrode roller 33.

In the present embodiment, as described above, the position on the frictional charging series of the first toner is brought more toward the opposite polarity than the second toner and therefore, after having mixed into the second developing device 6, the first toner frictionally contacts the second toner, whereby the average amount of charge of the first toner is liable to become smaller than the average amount of charge of the second toner. Accordingly, the effect of the first toner 8 being separated and discharged out of the second developing device 6 is improved. Also, by combining the electric dust collection by the electrode roller 33 with it, the collection efficiency for the first toner is also improved.

The details of the first developing and the second developing in the present embodiment are as follows.

First Developing first toner: non-magnetic toner, red
binder resin: styrene acryl
extraneous additive: silica 0.5 part by weight
average particle diameter: 9.0 $\mu$m
average amount of charge after mixing: −1.2 $\mu$C/g developing: method non-magnetic one-component non-contact alternate electric field developing method elastic blade: nylon-coated urethane rubber blade
bearing pressure: 10 g/cm (line pressure)

Second Developing second toner: magnetic toner, black
binder resin: polyester
extraneous additive: silica 0.6 part by weight
average particle diameter: 9.0 $\mu$m
average amount of charge: −10.5 $\mu$C/g developing method: magnetic one-component non-contact alternate electric field developing method In the present embodiment, by the above-described construction, two-color image formation on 10,000 sheets was effected in accordance with Embodiment 1. As a result, the color mixing by the mixing of the first toner was not found in the obtained two color image, and the first toner having mixed into the second developing device 6 was collected on the electrode roller 33 below the second developing device 6.

As described above, the average amount of charge of the first toner immediately after having mixed into the second developing device 6 was −1.2 $\mu$C/g on the developing sleeve, but the average amount of charge of the collected first toner was +0.5 $\mu$C/g by the charging of the opposite polarity.

In the present embodiment, as described above, the kinds of binder resins of the toner were changed to control the positional relation on the friction charging series between the first toner and the second toner, but besides this, the kinds of a charging control agent, wax, etc. may be changed to facilitate control.

Embodiment 8

This embodiment uses the duty bias shown in FIG. 5B as the developing bias used in the second developing by the second developing device 6 in Embodiment 5. In other aspects, this embodiment is similar to Embodiment 5. This duty bias, as compared with the rectangular wave bias shown in FIG. 5A, has its lower peak voltage value made small and its application time made long.

According to the above-described duty bias, the alternate electric field formed between the photosensitive drum 1 and the developing sleeve 7 of the second developing device 6 is greater in its peak value in a direction to move the toner from the developing sleeve 7 to the photosensitive drum 1 side than in its peak value in a direction to draw the toner from the photosensitive drum 1 back to the developing sleeve 7 side. Thus, according to the present embodiment, the mixing itself of the first toner 8 into the second developing device 6 can be considerably mitigated.

Embodiment 9

In this embodiment, as in Embodiment 1, the magnetic one-component contact alternate electric field developing method was used in the second developing by the second developing device 6 of FIG. 2, and the non-magnetic one-component non-contact alternate electric field developing method was used in the first developing by the first developing device 3 of FIG. 3. The present embodiment is characterized in that the average mount of charge (per unit mass) of the first toner 8 after having mixed into the second developing device 6 is made smaller than the average amount of charge of the first toner before mixing into the second developing device 6 and the average amount of charge of the first toner before mixing into the second developing device 6 is made greater than the average amount of charge of the second toner 9. As a result, the influence of the first toner, having mixed into the second developing device, on the second toner image can be eliminated while the high quality of the first toner image by the first developing is maintained, and the efficient separation and collection of the first toner from the second developing device are made possible.

To effectively accomplish only the separation and collection of the first toner 8 from the second developing device 6, as previously described, the average amount of charge of the first toner can be made lower than the average amount of charge of the second toner, but if this is done, it will become difficult to faithfully effect the first developing using the non-magnetic one-component non-contact developing method as in the present embodiment, and the first toner image obtained will become an image increased in fog and scatter. Also, the reflection force of the first toner to the photosensitive drum 1 is low and therefore, when the first toner image arrives at a second developing area in which the photosensitive drum 1 and the second developing device 6 are opposed to each other, there will arise the phenomenon that the quantity of the first toner mixing into the second developing device 6 increases.

In the present embodiment, however, the first toner 8 is regulated into a thin layer on the developing sleeve 4 in the first developing device 3 by the elastic blade 13 and is subjected to sufficient friction charging, whereby the average amount of charge of the first toner is made sufficiently higher than that of the second toner 9 which is a magnetic toner used in the second developing device 6. As a result, the higher quality first developing with the first toner 8 is achieved and also, the reflection force of the first toner to the photosensitive drum 1 is high and therefore, the prevention of the mixing of the first toner into the second developing device 6 in the second developing area is expedited.

However, as already described with respect to the prior art, there exists not a little of the first toner which still mixes into the second developing device 6 due to the contrast between the first developing bias and the potential of the first image portion.

In the present embodiment, however, as described above, the average amount of charge of the first toner 8 after the mixing is made to become smaller than that before the mixing. That is, the positional relation on the frictional charging series of the first toner 8 with respect to the second toner 9 is controlled so that when the first toner 8 has mixed into the second developing device 6, it may frictionally contact the second toner 9 to thereby decrease its amount of charge. Further, the second toner 9 is a magnetic toner and not only electrostatically adheres to the developing sleeve 7 of the second developing device 6, but also is magnetically attracted to the developing sleeve 7 by the magnetic force of the magnet 15 thereof and therefore, in the second developing device 6, the second toner 9 is readier to be selectively applied onto the developing sleeve 7 than the first toner 8. As a result, the first toner 8, having mixed into the second developing device 6, hardly frictionally contacts the developing sleeve 7, and in the second developing device 6, the average amount of charge of the first toner 8 is further reduced.

The first toner 8, thus reduced in its amount of charge in the second developing device 6, comes to the second developing area while weakly adhering to the second toner 9 on the developing sleeve 7, and by the AC bias part of the developing bias there and the rotation of the developing sleeve 7, it wafts between the developing sleeve 7 and the photosensitive drum 1 and gradually becomes not maintained on the developing sleeve 7 and the photosensitive drum 1, and falls below the developing sleeve 7 outside the second developing device 6. That is, the first toner 8 is separated and discharged out of the second developing device 6 and is not accumulated in the second developing device 6. Also, there is no influence of the first toner 8 on the second toner image.

Figure 10:
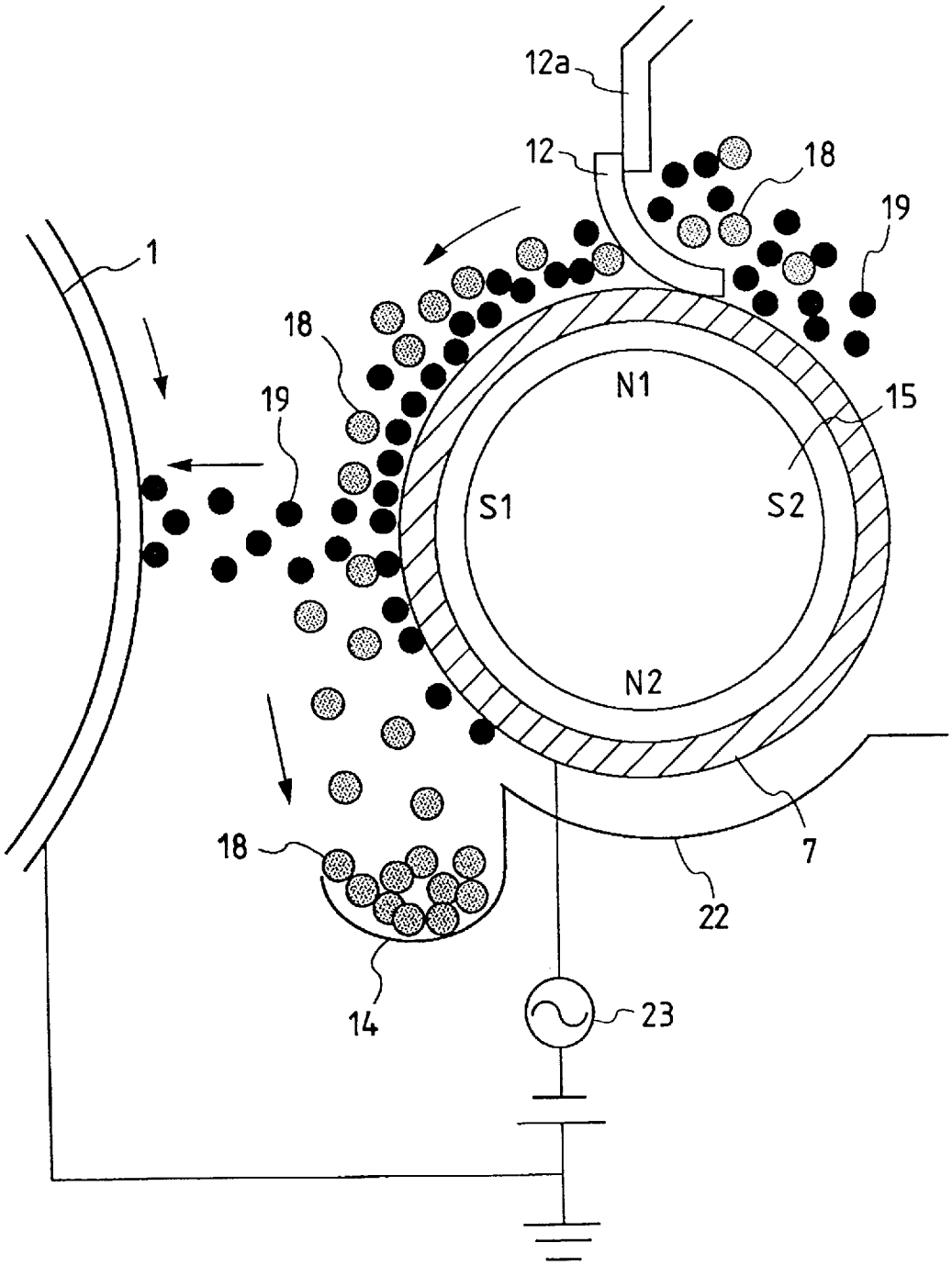
FIG. 10 is a cross-sectional view showing the developing area of a second developing device installed in the image forming apparatus of FIG. 9.

The first toner 8 discharged and having fallen out of the second developing device 6 is received by and collected in the receiving dish 14 of FIG. 10.

By making the average particle diameter of the first toner 8 larger than the average particle diameter of the second toner 9, the first toner 8, having mixed into the second developing device 6, can be more efficiently separated and collected.

A specific example of the present embodiment will be shown below.

The image forming apparatus of FIG. 7 was used and two-color image formation was effected by the two-color multiplex developing method. The first developing device 3 of FIG. 3 was used in the first developing, and the second developing device 6 of FIG. 2 was used in the second developing.

The details of conditions such as the first toner and the second toner used in the-first developing and the second developing are as follows.

First Developing first toner: non-magnetic toner, red
binder resin: polyester
extraneous additive: dry type silica 0.5 part by weight
average particle diameter: 8.5 $\mu$m
developing method: non-magnetic one-component non-contact alternate electric field developing method
elastic blade: nylon-coated urethane rubber blade
bearing pressure: 10 g/cm (line pressure)

Second Developing second toner: magnetic toner, black
binder resin: polyester
extraneous additive: oil-treated silica 1.0 part by weight
average particle diameter: 6.0 $\mu$m
average amount of charge: −10.5 $\mu$C/g
developing method: magnetic one-component non-contact alternate electric field developing method In the present embodiment, the above-mentioned conditions were used in the first developing and the second developing and two-image formation on 10,000 sheets was effected by the two-color multiplex developing method.

As a result, in the two-color image obtained, the first toner image was of a high quality free of scatter or the like and color mixing by the mixing of the first toner was not found in the second toner image. Also, about 30 mg of the first toner having mixed into the second developing device 6 was collected in the receiving dish 14 below the second developing device 6.

Also, the average amount of charge of the first toner, which was 25–40 $\mu$C/g on the developing sleeve of the first developing device, was 0–5 $\mu$C/g when it was collected in the receiving dish via the second developing device. The average amount of charge of the second toner did not change before and after the mixing of the first toner and was 10–20 $\mu$C/g.

COMPARATIVE EXAMPLE 1

In Embodiment 1, a non-magnetic red toner was used as the first toner 8 in the first developing device 3, a urethane rubber blade was used as the elastic blade 13, and the average amount of charge of the first toner 8 on the developing sleeve 4 was 10–15 $\mu$C/g. In other aspects, in the same manner as in Embodiment 1, two-color image formation was performed.

As a result, at a point of in time at which image formation on about 100 sheets was effected, many instance of scattering were found in the red toner image as the first toner image, and the color mixing by the red toner, having mixed into the second developing device, was confirmed in the obtained two-color image.

Embodiment 10

Figure 4:
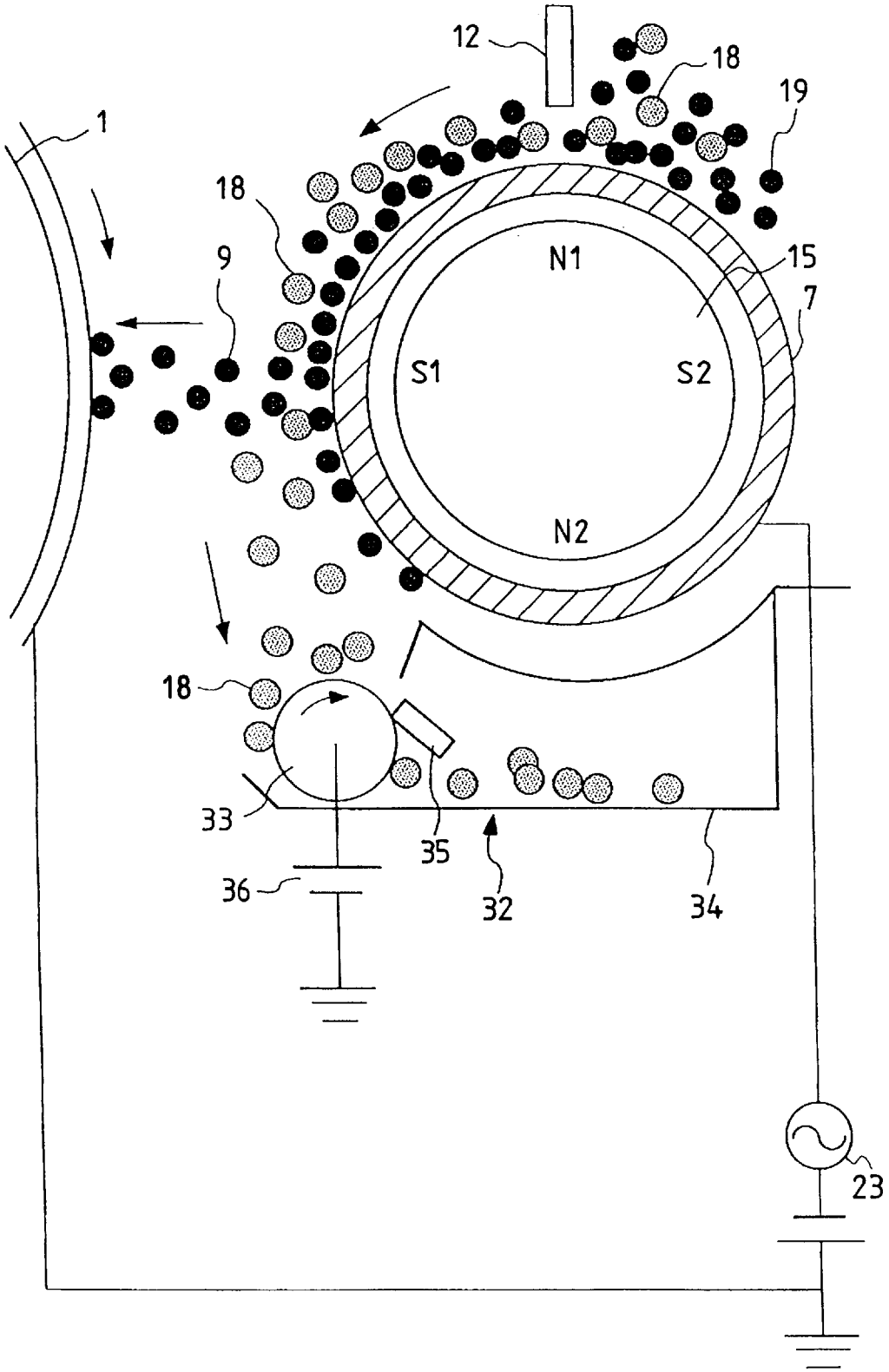
FIG. 4 is a cross-sectional view showing the essential portions of a second developing device having installed therein an electric dust collector used in still another embodiment of the present invention.

In this embodiment, a developing device having an air dust collector 26 installed as the separating and collecting means shown in FIG. 4 was used as the second developing device 6 for effecting the second developing in Embodiment 5. Also, the duty bias as shown in FIG. 5B was used as the developing bias of the second developing. In other aspects, the construction of the present embodiment is basically similar to that of Embodiment 5.

According to this duty bias, the alternate electric field formed between the photosensitive drum 1 and the developing sleeve 7 of the second developing device 6, relative to the potential on the drum in the second developing area, is greater in its peak value in a direction to move the toner from the developing sleeve 7 to the photosensitive drum 1 side than in its peak value in a direction to draw the toner from the photosensitive drum 1 back to the developing sleeve 7 side. In the present embodiment, the application times of these peak values were the same.

According to the present embodiment, the force of the electric field by which the first toner image on the photosensitive drum 1 is drawn back to the developing sleeve 7 side of the second developing device 6 is weakened by the application of the above-mentioned duty bias and therefore, the mixing itself of the first toner 8 into the second developing device 6 can be considerably mitigated.

The first toner 8, having mixed into the second developing device 6, and thereafter separated and discharged out of the second developing device 6, falls below the developing sleeve 7 and is collected into the box 30 by the suction by the air dust collector 26.

A specific example of the present embodiment will be shown below.

The details of conditions such as the first toner used in the first developing and the second toner used in the second developing and as follows.

First Developing first toner: non-magnetic toner, red
binder resin: polyester
extraneous additive: silica 0.5 part by weight
average particle diameter: 8.5 μm developing method: non-magnetic one-component non-contact alternate electric field developing method elastic blade: nylon urethane rubber blade
bearing pressure: 10 g/cm (line pressure)

Second Developing second toner: magnetic toner, black
binder resin: polyester
extraneous additive: silica 1.0 part by weight
average particle diameter: 6.0 μm developing method: magnetic one-component non-contact alternate electric field developing method In the present embodiment, the above-mentioned conditions were used in the first developing and the second developing and two-color image formation on 10,000 sheets was effected by the two-color multiplex developing method.

As a result, in the two-color image obtained, the first toner image was of a high quality, free of scatter or the like, and color mixing by the mixing of the first toner was not found in the second toner image. Also, about 15 g of the first toner, having mixed into the second developing device 6, was collected in the air dust collector 26 below the second developing device 6, and the amount of mix of the first toner was smaller than in the case of Embodiment 5.

Embodiment 11

In this embodiment, the position on the frictional charging series of the first toner 8 in Embodiment 5 was made more toward the opposite polarity than that of the second toner 9 so that the average amount of charge of the first toner, after having mixed into the second developing device 6, might become smaller than the average amount of charge of the first toner before mixing into the second developing device. Specifically, use is made of a first toner in which the binder resin of the first toner 8 was replaced by a binder resin of the styrene acryl line, and by the use of a binder resin of the polyester line, the control of the position on the frictional charging series was effected. Also, as the second developing device 6 for effecting the second developing, use was made of the one shown in FIGS. 5A and 5B, wherein the electric dust collector 32 is installed as the separating and collecting means. In other aspects, the construction of the present embodiment is basically similar to that of Embodiment 5.

Since the position on the frictional charging series of the first toner is brought more toward the opposite polarity than that of the second toner, the first toner, after having mixed into the second developing device 6, frictionally contacts with the second toner, whereby the average amount of charge of the first toner is liable to become considerably smaller than the average amount of charge of the second toner and in some cases, the first toner may be charged to the opposite polarity. Accordingly, the effect of the first toner 8 being separated and discharged out of the second developing device 6 is improved and by combining the electric dust collection by the electrode roller 33 with it, the collection efficiency of the first toner is also improved. To collect the first toner, a negative voltage of the order of 1000 V is applied to the electrode roller 33.

The details of the first developing and the second developing in the present embodiment are as follows.

First Developing first toner: non-magnetic toner, red
binder resin: styrene acryl
extraneous additive: silica 0.5 part by weight
average particle diameter: 9.0 μm
average amount of charge after mixing: −1.2 μC/g developing method: non-magnetic one-component non-contact alternate electric field developing method elastic blade: nylon-coated urethane rubber blade
bearing pressure: 10 g/cm (line pressure)

Second Developing second toner: magnetic toner, black
binder resin: polyester
extraneous additive: silica 0.6 part by weight
average particle diameter: 9.0 μm developing method: magnetic one-component non-contact alternate electric field developing method In the present embodiment, the above-mentioned conditions were used in the first developing and the second developing and two-color image formation of 10,000 sheets was effected by the two-color multiplex developing method.

As a result, in the two color image obtained, the first toner image was of a high quality, free of scatter or the like and color mixing by the mixing of the first toner was not found in the second toner image. Also, the first toner, having mixed into the second developing device 6, was collected in the electric dust collector 32 below the second developing device 6. The average amount of charge of the collected first toner, which was 20 to 30 μC/g on the developing sleeve 4 of the first developing device, was nearly 0 μmC/g. The average amount of charge of the second toner did not change before and after the mixing and was of the order of 10 to 15 μC/g.

In the present embodiment, the kinds of the binder resins of the toners were changed to control the positional relation on the frictional charging series between the first toner and the second toner, but besides this, the kinds of a charge control agent, wax, etc. may of course be changed to facilitate control.

Embodiment 12

Figure 9:
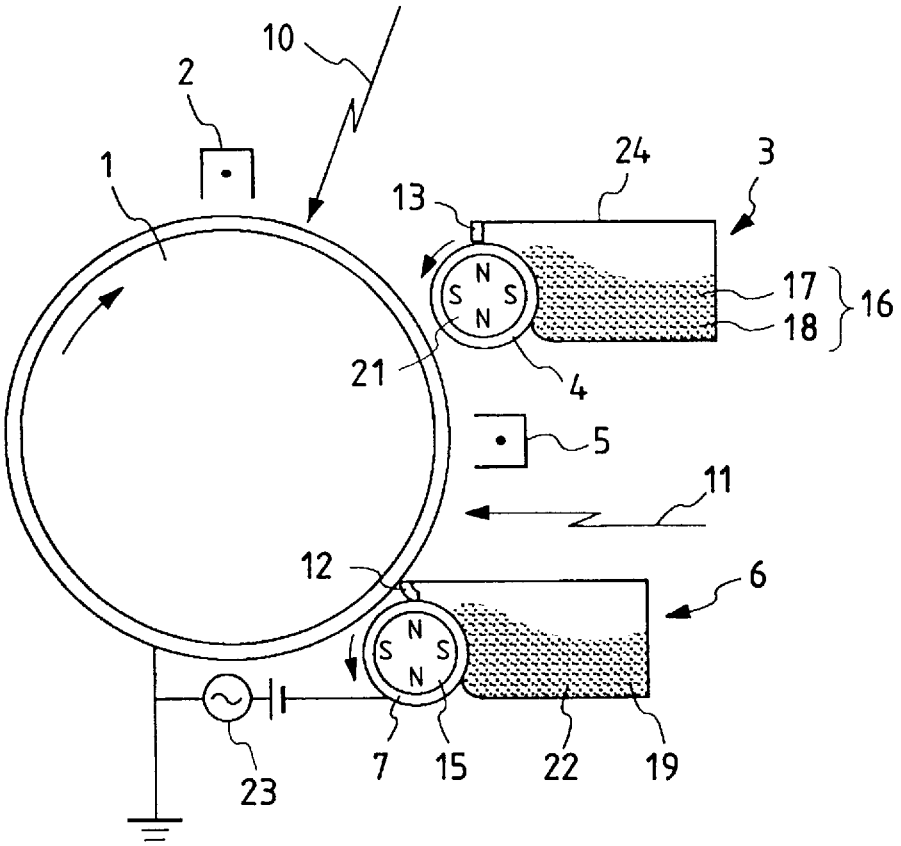
FIG. 9 schematically shows the construction of a two-color image forming apparatus by which another two-color multiplex developing method according to the present invention is carried out.

FIG. 9 schematically shows the construction of a two-color image forming apparatus by which the two-color multiplex developing method according to the present invention is carried out, and FIG. 10 is a cross-sectional view showing the developing area of a second developing device installed in the image forming apparatus of FIG. 9.

This two-color image forming apparatus, as shown in FIG. 9, is comprised of an electrophotographic photosensitive drum (photosensitive medium) 1, which is a latent image forming medium, and around it are provided, a first charger 2, a first exposure device (not shown) for effecting first exposure 10, a first developing device 3, a second charger (re-charger) 5 and a second exposure device (not shown) for effecting second exposure 11.

The two-color image forming apparatus uniformly charges the surface of the photosensitive drum 1 by the charger 2, whereafter it effects the first exposure 10 to thereby form a first latent image, develops the first latent image by the first developing device 3 by the use of a first toner 18 to thereby form a first toner image, and then again uniformly charges the surface of the photosensitive drum 1 by the charger (re-charger) 5, whereafter it effects the second exposure 11 to thereby form a second latent image, and develops the second latent image by the second developing device 6 by the use of a second toner 19 differing in color from the first toner 18 to thereby form a second toner image. As a result, a two-color image by the two-color multiplex developing method is obtained on the photosensitive drum 1.

The two-color image on the photosensitive drum 1 is thereafter collectively transferred onto transfer paper by a transfer charger, not shown, whereafter the transfer paper is conveyed to a fixating device, by which the fixation of the two-color toner image is effected to thereby provide a two-color print. Thus, all steps of the two-color image formation by the two-color multiplex developing method are terminated, and the two-color print is discharged out of the image forming apparatus.

In the above-described two-color multiplex developing method, when the second toner 19 for developing the second latent image comes into contact with the first toner image and stripes off the first toner 18, there takes place the mixing of the first toner 18 into the second developing device 6. The magnetic one-component non-contact jumping developing method, i.e., the magnetic one-component non-contact alternate electric field developing method, is best suited for the prevention of the mixing of the first toner 18 into the second developing device 6 and for the efficient collection of the first toner 18 having mixed into the second developing device. Accordingly, in the present invention, this is adopted for the second developing device 6.

The second developing device 6, as shown in FIGS. 9 and 10, is provided with a developer container 22 containing therein a magnetic toner as the second toner 19, and has a developing sleeve 7 rotatable in the direction of arrow in the opening portion of the developer container 22 which faces the photosensitive drum 1. A roller-like magnet 15 is disposed against rotation in the developing sleeve 7, and according to the present embodiment, an elastic blade 12 as a toner regulating member is provided above the developing sleeve 7. This elastic blade 12 is mounted on the developer container 22 by a holder 12*a*, bears against the upper portion of the developing sleeve 7 in a direction opposite to the direction of rotation thereof, and is urged against the developing sleeve 7. A bias voltage source 23 is connected between the developing sleeve 7 and the photosensitive drum 1 and during development, an alternate voltage, comprising a DC voltage, superposed on an AC voltage is applied as a developing bias to the developing sleeve 7.

To efficiently separate and remove the first toner 18 from within the second developing device 6 when the first toner 18 has mixed into the second developing device 6, it is advantageous to make the average amount of charge per unit volume of the first toner 18, after having mixed into the second developing device 6, smaller than the average amount of charge per unit volume of the second toner 19.

So, in the present invention, the binder species and/or extraneous additive species of the first toner 18 and the second toner 19 are adjusted or the material of the elastic blade 12 is adjusted to thereby set the positions on the frictional charging series of these so as to be the second toner 19>the elastic blade 12>the first toner 18, that is, more toward the opposite polarity in the order of the second toner, the elastic blade, and the first toner.

According to this, even when it is taken into account that the first toner 18, having mixed into the second developing device 6, is charged to its original polarity by its frictional contact with the developing sleeve 7, the first toner is subjected to the charging in the direction of the opposite polarity so as to negate it by its frictional contact with the second toner 19, and the amount of charge of the first toner is sufficiently reduced. Accordingly, the average amount of charge of the first toner 18 after mixing, becomes smaller than the average amount of charge of the second toner, and this is convenient for efficiently separating and removing the first toner 18 from within the second developing device 6.

Also, the second toner 19, which is a magnetic toner, unlike the first toner 18 which is a non-magnetic toner carried on the developing sleeve 7 by only an electrostatic force, has also magnetic attraction and therefore is selectively applied onto the developing sleeve 7 in the second developing device 6. Therefore, the first toner 18 loses a chance for frictionally contacting with the developing sleeve 7 and in this connection, the amount of charge of the first toner 18 is further reduced.

Also, when for example, during the first developing, scattering and leakage of the first toner 18 occur accidentally and a great deal of first toner 18 has mixed into the second developing device 6, if the medium for reducing the amount of charge of the first toner 18 is the second toner 19 alone, it will take a long time to reduce the amount of charge of the first toner 18 having mixed into the second developing device 6 and to separate the first toner 18 from within the second developing device 6, and this will lead to the occurrence of color mixing of the image before that.

In the present invention, the elastic blade 12 elastically bearing against the developing sleeve 7 is used as the toner regulating member of the second developing device 6 and therefore, in the bearing portion, the first toner 18, having mixed, can be made to strongly rub against the second toner 19 and the elastic blade 12 to thereby further expedite the reduction in the amount of charge of the first toner 18. Accordingly, even if the first toner 18 temporarily mixes into the second developing device 6 in a great deal, the amount of charge thereof can be reduced early.

In the present invention, the significance of the amount of charge of the first toner 18 being reduced after its mixing into the second developing device 6 resides in the weakening of the reflection force of the first toner 18 to the developing sleeve 7 of the second developing device 6 and in the developing area of the second developing device 6, the first toner 18 becomes ready to separate from the developing sleeve 7.

That is, the second toner 19 retains an appropriate amount of charge by the friction thereof with the elastic blade 12, but the first toner 18, having mixed into the second developing device, is reduced in its amount of charge by the friction between the elastic blade 12 and the second toner 19, as described above, and therefore the second toner 19 becomes relatively high in the amount of charge, and as a result, the reflection force thereof to the developing sleeve 7 of the second developing device 6 is strong. Therefore, in the developing area of the second developing device 6, the second toner 19 is selectively applied onto the developing sleeve 7 or adheres onto the photosensitive drum, is such a manner as to be screened by the AC bias of the developing bias. On the other hand, the first toner 18, reduced in the amount of charge, is weak in the reflection force thereof to the developing sleeve 7 and in the developing area of the second developing device 6, it wafts between the developing sleeve 7 and the photosensitive drum 1 due to the AC bias of the developing bias, and gradually becomes not maintained on the photosensitive drum 1 and the developing sleeve 7 and falls below the developing sleeve 7 outside the second developing device 6.

Thus, according to the present invention, the first toner 18 is separated and discharged out of the second developing device 6 and is not accumulated in the second developing device 6. Also, the influence of the first toner 18 on the second toner image is null. Regarding the second developing itself, by the thin layer application of the second toner 19 onto the developing sleeve 7 by the elastic blade 12, the second toner gets a sufficient amount of frictional charge and therefore, a second toner image of high quality can be formed.

Further, in the present invention, means for separating and collecting the first toner 18, having mixed into the second developing device 6, is installed near the developing sleeve 7 of the second developing device 6. According to the present embodiment, this separating and collecting means is provided as a receiving dish 14 located below the gap portion in which the developing sleeve 7 and the photosensitive drum 1 are opposed to each other. This receiving dish 14 is mounted in the lower portion of the opening portion of the developer container 22 of the second developing device 6. The first toner 18 discharged out of the second developing device 6 is received by and collected in the receiving dish 14.

In the present embodiment, the first developing device 3 adopts the two-component magnetic brush developing method. The first developing device 3 contains in the developer container 24 a two-component developer 16 composed of a mixture of a non-magnetic toner (first toner) 18 and a magnetic carrier 17. This developer 16 is carried onto the developing sleeve 4 by the pumping-up pole of a roller-like magnet 21 therein and the developing sleeve 4 is rotated, whereby the developer 16 is conveyed to the developing area opposed to the photosensitive drum 1 and in the course of the conveyance, the layer thickness of the developer 16 on the developing sleeve 4 is magnetically regulated by the magnetic blade 13 and the regulating pole of the magnet 21 and is applied as a thin layer, and in the developing area, the developer 16, in the form of a thin layer, is formed into a magnetic brush by the developing pole of the magnet 21. By an alternate bias applied to the developing sleeve 4, an alternate electric field is then created in the developing area, whereby the first toner 18 in the developer 16 on the developing sleeve 4 is made to fly to the photosensitive drum 1 to thereby develop the first latent image on the photosensitive drum 1 and visualize it as a toner image.

The present embodiment, constructed as described above, adopts the magnetic one-component non-contact alternate electric field developing method in the second developing, and adjusts the binder species and/or the extraneous additive species with respect to the first toner used in the first developing and the second toner used in the second developing, or adjusts the material of the elastic blade of the second developing device to thereby bring the positions on the frictional charging series of the first toner, the second toner, and the elastic blade of the second developing device more toward the opposite polarity in the order of the second toner>the elastic blade>the first toner and to make the average amount of charge of the first toner smaller than the average amount of charge of the second toner after the mixing of the first toner into the second developing device. Accordingly, when the first toner has mixed into the second developing device, the reflection force of the first toner to the developing sleeve of the second developing device can be made weaker than that of the second toner and the first toner, having mixed into the second developing device, can be separated and collected without being accumulated in the second developing device. Accordingly, the high quality of the first toner image on the photosensitive drum by the first toner can be maintained, while the influence of the first toner, which could cause color mixing of the second toner image, can be eliminated and a two-color image of high quality can be obtained easily.

In the foregoing, the two-component magnetic brush developing method is adopted in the first developing by the first developing device 3, but in the present invention, the non-magnetic one-component developing method using a non-magnetic toner alone, and more particularly the non-magnetic one-component non-contact alternate electric field developing method can also be adopted in the first developing, and this is more preferable.

In such case, if use is made of a method, of regulating the non-magnetic toner into a thin layer by the elastic blade urged against the developing sleeve and using it for developing, it will be better as the first developing. This is because if the non-magnetic toner is made into a thin layer on the developing sleeve by the elastic blade, the amount of charge can be made sufficiently high and accordingly, if this is used as the first toner having its amount of charge made lower after having mixed into the second developing device 6, the first developing can be effected by the first toner of which the amount of charge is sufficient and as a result, the scattering and fogging of the toner during the first developing can be prevented and in this connection, the high quality of the first toner image can be maintained. This is also because the amount of charge is high and the adhering force to the photosensitive drum is great and therefore it becomes difficult for the stripping-off of the first toner image on the developing area of the second developing device to occur and thus, the mixing of the first toner into the second developing device due to the stripping-off can be decreased.

Also, in the present embodiment, the binder species and extraneous additive species of the first toner and the second toner and the material of the elastic blade are adjusted to thereby set the positions on the frictional charging series to the second toner>the elastic blade>the first toner, but the larger the average particle diameter of the toner, the smaller the amount of charge per unit volume and therefore, if in addition to the setting of the positions on the frictional charging series of the first toner, the second toner and the elastic blade, the average particle diameter of the first toner is made larger than the average particle diameter of the second toner, the amount of charge of the first toner after mixing can be further reduced. Accordingly, the effect of the separation and collection of the first toner having mixed into the second developing device can be made efficient.

A specific example of the present embodiment will be shown below.

The image forming apparatus of FIG. 9 was used and two-color image formation was effected by the two-color multiplex developing method. The two-component magnetic brush developing method was adopted in the first developing by the first developing device 3. The second developing by the second developing device 6 is the magnetic one-component non-contact developing method.

The details of conditions, such as the first toner and the second toner used in the first developing and the second developing, are as follows.

First Developing
- first toner: non-magnetic toner, red
  - binder resin: styrene acryl
  - extraneous additive: silica 0.5 part by weight
  - average particle diameter: 8.5 $\mu$m
- carrier: fluorine and acryl resin-coated ferrite magnetic particles
  - average particle diameter: 55 $\mu$m mixing ratio of toner and carrier: 10%
- developing method: two-component magnetic brush developing method Second Developing
- second toner magnetic toner, black
  - binder resin: polyester
  - extraneous additive: hydrophobically treated silica 1.0 part by weight
  - average particle diameter: 8.5 $\mu$m developing method: magnetic one-component non-contact alternate electric field developing method elastic blade: acryl-coated urethane rubber blade When, as described above, the toner of styrene acryl is regulated on the developing sleeve by the elastic blade of acryl-coated urethane rubber, it has been confirmed by an experiment beforehand that the toner is hardly charged. Thus, in the present embodiment, the relation that the second toner>the elastic blade>the first toner is established at the positions on the frictional charging series. Therefore, the first toner, having mixed into the second developing device, frictionally contacts both of the second toner and the elastic blade and the amount of charge of the first toner is reduced and thus, the separation and collection of the first toner from within the second developing device is expected.

With the above-mentioned conditions used in the first developing and the second developing, two-color image formation on 10,000 sheets was done by the two-color multiplex developing method. As a result, color mixing by the mixing of the first toner was not found in the obtained two-color image, and about 30 mg of the first toner having mixed into the second developing device 6 was collected in the receiving dish 14 below the second developing device 6.

Also, the average amount of charge of the first toner, which was −20 to −40 μC/g on the developing sleeve of the first developing device, was nearly 0 μC/g when the first toner was collected. The average amount of charge of the second toner did not charge before and after the mixing of the first toner and was about −10 to −20 μC/g.

COMPARATIVE EXAMPLE 4

A non-magnetic toner of polyester having an average particle diameter of 8.5 μm was used as the first toner, and a magnetic toner of styrene acryl having an average particle diameter of 9.0 μm was used as the second toner. In other aspects, in the same manner as in Embodiment 1, two-color image formation was effected.

As a result, at a point in time at which image formation on about 100 sheets was done, the first toner (red toner) having, mixed onto the developing sleeve of the second developing device, was accumulated, and when thereafter image formation of a single color, black, was done by the second developing alone, the black image was reproduced with a reddish tinge by the first toner.

Embodiment 13

Figure 11:
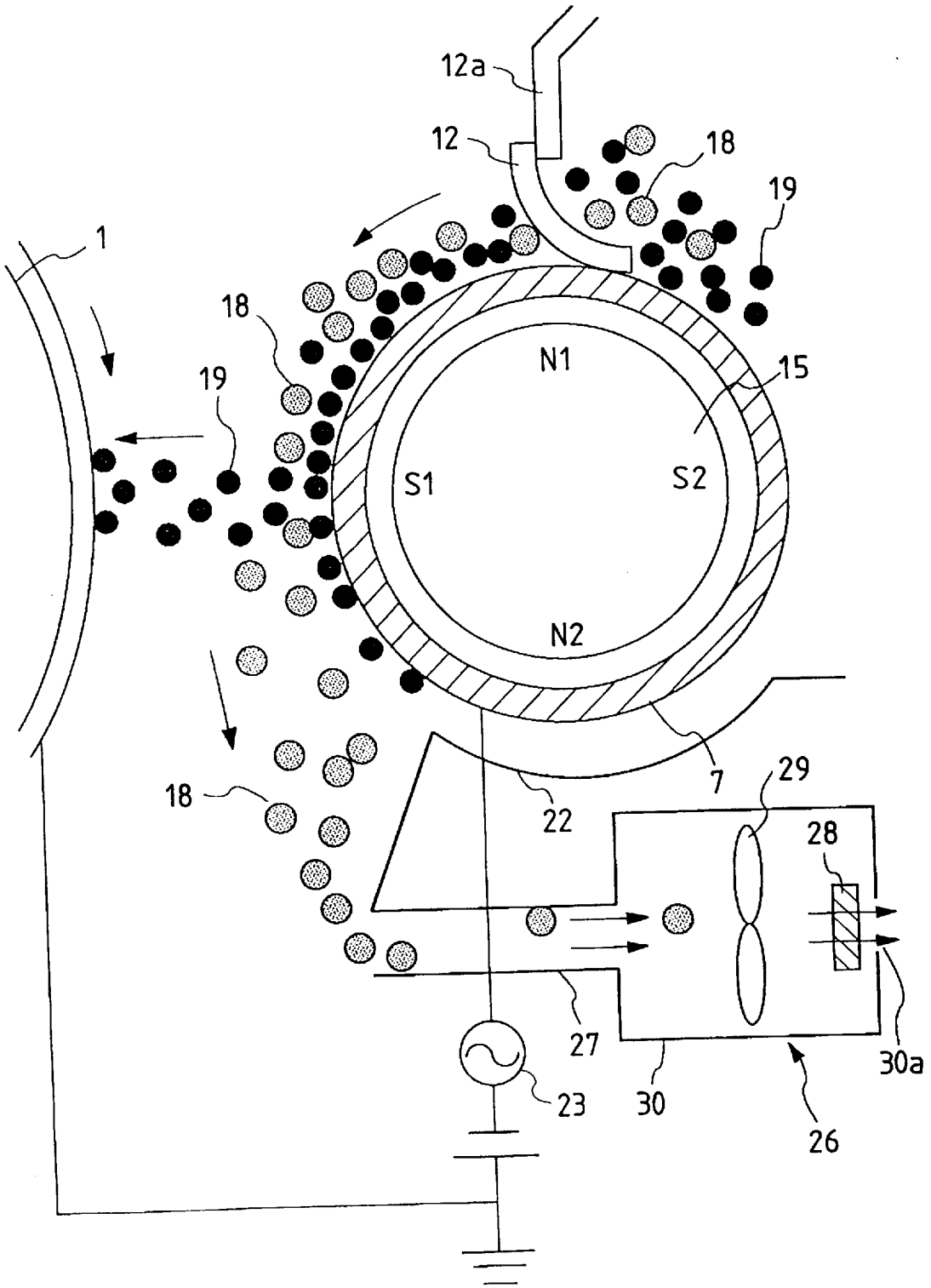
FIG. 11 is a cross-sectional view showing the essential portions of a second developing device having installed therein an air dust collector used in another embodiment of the present invention.

In this embodiment, the first developing device 3 in Embodiment 12 was replaced by a non-magnetic one-component developing device, not shown, and the first developing was effected by the non-magnetic one-component developing method. In the second developing device 6 for effecting the second developing, as shown in FIG. 11, an air dust collector 26 was installed as the separating and collecting means. In other aspects, the construction of the present embodiment is basically similar to that of Embodiment 12.

The air dust collector 26 comprises a fan 29 contained in a duct 30, a filter 28 contained in the duct 30 and disposed in an exhaust port 30*a* rearward of the fan 29, and a duct 27 provided on the filter 28 side of the duct 30, and the duct 27 is made to face a location below the gap portion in which the developing sleeve 7 and the photosensitive drum 1 are opposed to each other.

When the fan 29 is rotated to discharge the air in the duct 30 from the exhaust port 30*a* thereof, there is created a suction force which makes the air flow from the gap portion between the developing sleeve 7 and the photosensitive drum 1 through the duct 27 into the duct 30. Accordingly, as shown in FIG. 11, the second toner 18 is separated and discharged out of the second developing device 6 and falls below the developing sleeve 7, whereupon the first toner 18 passes through the duct 27 and is collected in the duct 30.

The details of the first toner and the second toner in the present embodiment are as follows.

First Developing first toner: non-magnetic toner, red
- binder resin: polyester
- extraneous additive: wet-treated silica 2.5 parts by weight
- average particle diameter 8.5 μm developing method: non-magnetic one-component non-contact alternate electric field developing method elastic blade: blade having a urethane rubber surface layer coated with nylon Second Developing second toner: magnetic toner, black
- binder resin: polyester
- extraneous additive: hydrophobically treated silica 2.5 parts by weight
- average particle diameter: 8.5 μm developing method: magnetic one-component non-contact alternate electric field developing method elastic blade: dry-treated silica dispersed urethane rubber blade Silica causes a difference in its chargeability depending on the manner of its treatment, and the frictional charging series become higher in chargeability in the order of the hydrophobically treated silica>the dry-treated silica>the wet-treated silica. In the present embodiment, the first toner is covered with the extraneously added wet-treated silica and the second toner is covered with the extraneously added hydrophobically treated silica, and the elastic blade has dry-treated silica dispersed therein. Accordingly, the second toner>the elastic blade>the first toner is established in the positional relation on the frictional charging series. Therefore, the first toner, having mixed into the second developing device, frictionally contacts both of the second toner and the elastic blade and the amount of charge of the first toner is reduced and thus, the separation and collection of the first toner from within the second developing device is expected.

In the present embodiment, the above-mentioned conditions were used in the first developing and the second developing, and two-color image formation on 10,000 sheets was effected by the two-color multiplex developing method.

As a result, color mixing by the mixing of the first toner was not found in the obtained two-color image, and the first toner, having mixed into the second developing device 6, was collected on the electrode roller 36 below the second developing device 6.

Also, the average amount of charge of the first toner, which was −25 to −50 μC/g on the developing sleeve of the first developing device, was nearly 0 μC/g when the first toner was collected. The average amount of charge of the second toner did not change before and after the mixing of the first toner into the second developing device and was about −10 to −20 μC/g.

Embodiment 14

In this embodiment, in addition to the setting of the positional relation on the frictional charging series among the first toner 18, the second toner 19 and the elastic blade 12 of the second developing device 6 in Embodiment 12, the average particle diameter of the first toner 18 was made larger than the average particle diameter of the second toner 19. Also, as shown in FIG. 12, in the second developing device 6 for effecting the second developing, an electric dust collector 32 was installed as the separating and collecting means. In other aspects, the construction of the present embodiment is basically similar to that of Embodiment 12.

The electric dust collector 32 comprises an electrode 33 to which a DC power source 36 is connected, and a box 34 containing it therein. The box 34 has an opening portion at a location below the gap portion in which the developing sleeve 7 and the photosensitive drum 1 are opposed to each other, and the electrode roller 33 is disposed in the opening portion. A DC voltage of the order of e.g. −1000 V is applied to the electrode roller 33 to electrically attract and collect the first toner 18 separated and discharged out of the second developing device 6 and falling below the developing sleeve 7, whereby the first toner attracted and adhering to the electrode roller 30 is removed by a scraper 35 bearing against the electrode roller 33.

The details of the first developing and the second developing in the present embodiment are as follows.

First Developing first toner: non-magnetic toner, red
binder resin: styrene acryl
extraneous additive: 0.5 part by weight
average particle diameter: 8.5 μm
developing method: two-component magnetic brush developing method Second Developing second toner: magnetic toner, black
binder resin: polyester
extraneous additive: silica 1.0 part by weight
average particle diameter: 6.0 μm elastic blade: acryl-coated urethane rubber blade
developing method: magnetic one-component non-contact alternate electric field developing method In the present embodiment, the above-mentioned conditions were used in the first developing and the second developing and two-color image formation on 10,000 sheets was effected by the two-color multiplex developing method. As a result, the color mixing by the mixing of the first toner was not found in the obtained two-color image, and the first toner, having mixed into the second developing device 6, was collected on the electrode roller 33 below the second developing device 6 in the same quantity as in Embodiment 12.

Also, the average amount of charge of the first toner, which was −20 to −40 μC/g on the developing sleeve of the first developing device, was +8 μC/g when the first toner was collected. This seems to be because in the present embodiment, a difference in the particle diameter between the toners was added and therefore, correspondingly thereto, the effect of reducing the amount of charge of the first toner became greater than in Embodiment 12 and amounted to such an extent as to reverse the charging polarity of the first toner. When the first toner having mixed into the second developing device thus reaches such an extent that the polarity thereof is reversed, the collection by the electrode roller 33 becomes more effective. The average amount of charge of the second toner did not change before and after the mixing of the first toner and was about −10 to −20 μC/g.

Embodiment 15

This embodiment used the duty bias shown in FIG. 5B as the developing bias for use in the second developing by the second developing device 6 in Embodiment 14. In other aspects, this embodiment is similar to Embodiment 14. This duty bias, as compared with the rectangular wave bias shown in FIG. 5A, in the alternate electric field formed between the photosensitive drum 1 and the developing sleeve 7 of the second developing device 6, is made smaller in its lower peak voltage value and longer in its application time.

According to the above-described duty bias, the peak value of the alternate electric field in a direction to move the toner from the developing sleeve 7 to the photosensitive drum 1 side becomes greater than the peak value in a direction to draw the toner from the photosensitive drum 1 back to the developing sleeve 7 side. Thus, according to the present embodiment, the mixing itself of the first toner into the second developing device 6 can be considerably mitigated.

In the present embodiment, when two-color image formation on 10,000 sheets was done by the above-described construction, color mixing by the mixing of the first toner was not found in the obtained two-color images, and the first toner, having mixed into the second developing device 6, was collected on the electrode roller 36 below the second developing device 6. This collected amount of the first toner is about half the case of Embodiment 14, and it is seen that the effect of reducing the amount of mixing of the first toner is provided by the duty bias.

Embodiment 16

Figure 13:
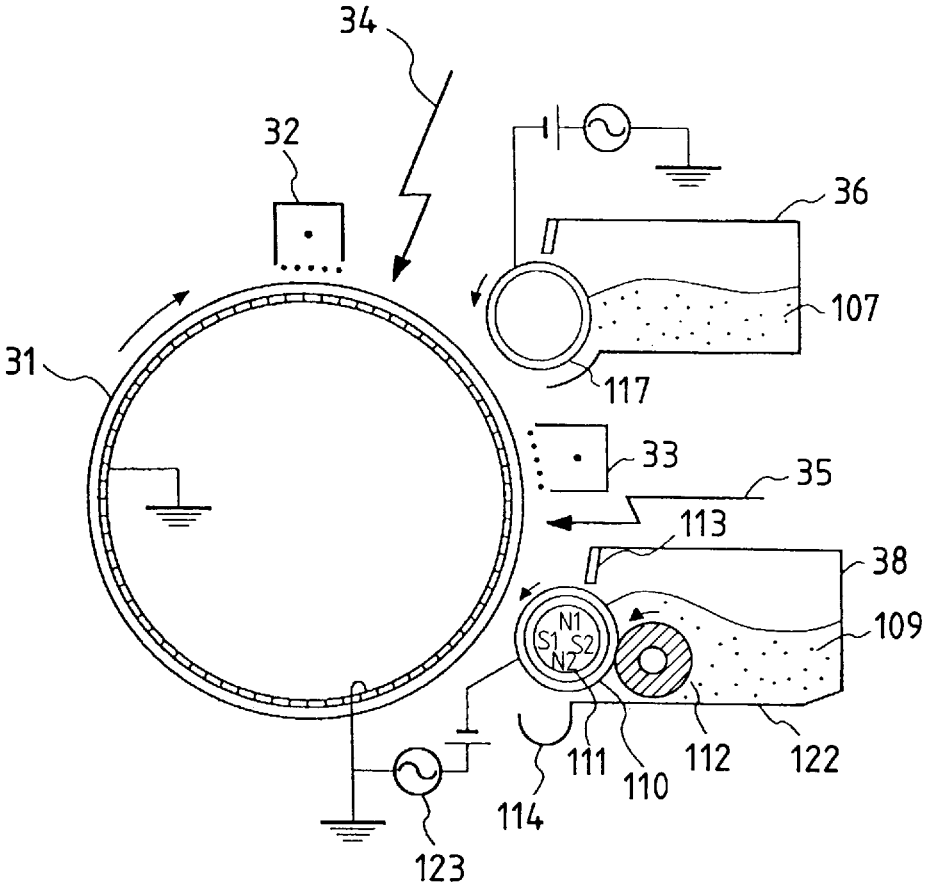
FIG. 13 schematically shows the construction of a two-color image forming apparatus by which still another two-color multiplex developing method according to the present invention is carried out.
Figure 14:
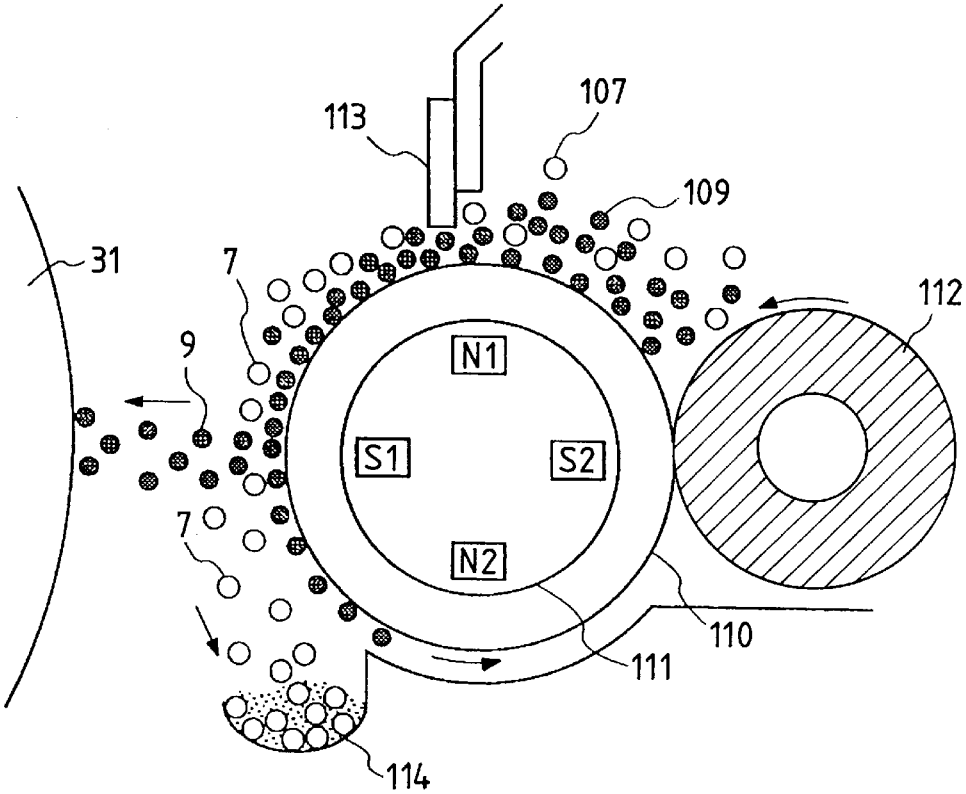
FIG. 14 is a cross-sectional view showing the essential portions of a second developing device installed in the image forming apparatus of FIG. 13.

FIG. 13 schematically shows the construction of a two-color image forming apparatus by which two-color multiplex developing method according to the present invention is carried out, and FIG. 14 is a cross-sectional view showing the developing area of a second developing device installed in the image forming apparatus of FIG. 13.

This two-color image forming apparatus, as shown in FIG. 13, is comprised of an electrophotographic photosensitive drum (photosensitive medium) 31 and around it are provided, a first charger 32, a first exposure device (not shown) for effecting first exposure 34, a first developing device 36, a second charger (re-charger) 33 and a second exposure device (not shown) for effecting second exposure 35.

The two-color image forming apparatus uniformly charges the surface of the latent image forming medium, i.e., the electrophotographic photosensitive drum 31 by the charger 32, whereafter it effects the first exposure 34 to thereby form a first latent image, develops the first latent image by the first developing device 36 by the use of a first toner 107 to thereby form a first toner image, and then again uniformly charges the surface of the photosensitive drum 31 by the charger (re-charger) 33, whereafter it effects the second exposure 35 to thereby form a second latent image, and develops the second latent image by a second developing device 38 by the use of a second toner 109 differing in color from the first toner 107 to thereby form a second toner image. As a result, a two-color image by the two-color multiplex developing method is obtained on the photosensitive drum 31.

Thereafter, the two-color image on the photosensitive drum 31 is collectively transferred onto transfer paper by a transfer charger, not shown, whereafter the transfer paper is conveyed to a fixating device, by which the two-color toner image is fixated, and it is provided as a two-color print. Thus, all steps of the two-color image formation by the two-color multiplex developing method are terminated, and the two-color print is discharged out of the image forming apparatus.

As the latent image forming medium, use may be made of a so-called xerography photosensitive medium on which an electrostatic latent image may be formed, for example, by the Carlson process, a photosensitive medium having an insulating layer on the surface thereof on which an electrostatic latent image may be formed by the NP process described in Japanese Laid-Open Patent Application No. 42-23910, an insulative medium on which an electrostatic latent image may be formed by the electrostatic recording method, an insulative medium on which an electrostatic latent image may be formed by the transfer method, or a member on which an electrostatic latent image (including a potential latent image) may be formed by other suitable method. In the present invention, as described above, a photosensitive drum is used as the latent image forming medium.

In the present embodiment, the first charger 32 and the re-charger 33 both are corona chargers with a grid. Semiconductor lasers are used as the first and second exposure devices. The toner 107 used in the first developing is a non-magnetic toner having a color, and the developing method may be the one-component developing method using a toner alone or the two-component developing method using a toner and a carrier.

The construction of the second developing device 38 in the present invention and the amounts of charge of the first toner 107 and the second toner 109 will now be described in detail with reference to FIGS. 13 and 14.

The second developing device 38 is provided with a developer container 122 containing therein a magnetic toner as the second toner 109, and has a developing sleeve 110 carrying the magnetic toner 109 on the surface thereof and rotatable in the direction of arrow, in the opening portion of the developer container 122 which faces the photosensitive drum 31. A roller-like magnet 111 is fixedly disposed against rotation in the developing sleeve 110, and above the developing sleeve 110, a magnetic blade 113 as a toner regulating member is disposed at a location opposed to a magnetic pole N1 disposed at the substantially upper position in the magnet 111, with a gap with respect to the developing sleeve 110.

The developing sleeve 110 is held in non-contact with the photosensitive drum 31 in a developing area opposed to the photosensitive drum 31, and a developing bias, comprising an AC voltage superposed on a DC voltage, is applied to the gap in the non-contact developing area by a bias voltage source 123, whereby the developing of the electrostatic latent image on the photosensitive drum 31 (the second developing) is carried out.

A toner supply roller 112 elastically bears against the surface of the developing sleeve 110 at a location upstream of the magnetic blade 113 with respect to the direction of rotation of the developing sleeve 110, and this supply roller 112 is rotated while bearing against the developing sleeve 110, and strips off the unused magnetic toner on the developing sleeve 110 and also supplies a fresh magnetic toner 109 in the container 122 and applies it onto the developing sleeve 110. The toner supply roller 112 comprises single-foaminess foamed rubber such as silicone rubber, EPDM rubber or CR rubber provided in the form of a roller on a metallic support shaft.

In the present embodiment, the positions on the frictional charging series of the surface of the toner supply roller 112, the second toner 109 and the first toner 107, having mixed into the second developing device 38, are brought more toward the opposite polarity in chargeability in the order of the second toner>the supply roller 2 the first toner having mixed, whereby the separating and collecting performance for the first toner 107, having mixed into the second developing device 38, is enhanced to thereby achieve the shortening of the discharge time of the first toner 107 from the second developing device 38. This will hereinafter be described.

If the toner supply roller 110 as described above is not disposed in the second developing device 38 and the first toner 107 has mixed into the second developing device 38, this first toner 107 will have its amount of charge reduced by its friction with the second toner 109. The process of reduction in the amount of charge of this first toner 107, according to our experiment, has been found to occur in a magnetic field formed by the magnetic blade 113 in the second developing device 38 and the magnet 111 in the developing sleeve 110 and the circulation of the second toner formed by the rotation of the developing sleeve 110, and a considerable time is required to sufficiently reduce the amount of charge of the first toner 107 having mixed into the second developing device.

Accordingly, when there is the possibility of the quantity of the first toner 107, which has mixed into the second developing device, increasing temporarily as when images high in the image proportion of the first developing, for example, solid images are continuously copied in a great deal, the amount of charge of the first toner 107, having mixed into the second developing device, may not be sufficiently reduced. Therefore, the first toner 107 adheres to the developing sleeve 110 and like the second toner 109, it comes to the developing area and is used for the developing of the second latent image on the photosensitive drum 31, whereby color mixing may occur to the second toner image obtained.

In the present embodiment, as described above, the positions on the frictional charging series of the surface of the toner supply roller 112, the second toner 109 and the first toner 107 having mixed are in the order of the second toner>the supply roller≧the first toner having mixed. The first toner 107, having mixed onto the developing sleeve 110 of the second developing device 38 in the second developing area, arrives at the nip portion between the developing sleeve 110 and the toner supply roller 112 with the rotation of the developing sleeve 110 and is positively frictionally charged with the second toner 109 and the surface of the supply roller 112 in the narrow space of the nip portion, but from the above-described positional relation on the frictional charging series, the amount of charge of the first toner 107, having mixed, is suddenly reduced. Conversely, the second toner 109, from the positional relation on the frictional charging series, is further given charging charges in this nip portion and the amount of charge of the second toner 109 is increased and therefore, the second toner 109 becomes liable to electrostatically preferentially adhere to the developing sleeve 110 and thus, with the aid also of the magnetic attraction effect, substantially the whole area of the surface of the developing sleeve 110 is covered with the second toner 109.

Accordingly, the first toner 107, having mixed, comes to the developing area while weakly adhering to the second toner 109 on the developing sleeve 110 with its reduced amount of charge and cannot follow the AC component of the developing bias there. As a result, the first toner 107, having mixed, scatters below the second developing device 38 and is discharged from the second developing device 38 and therefore, the separation and collection time of the first toner 107 from the developing device 38 is greatly shortened. On the other hand, the second toner 109 is further enhanced in its amount of charge as described above and therefore, as compared with the prior art, a high quality image is produced.

If the AC component of the second developing bias is made into a waveform in which the peak value (V1) for moving the toner to the photosensitive drum side is greater than the peak value (V2) for drawing the toner from the photosensitive drum back to the developing sleeve (referred to as V2/(V1+V2)=duty ratio), the first toner stripped off the photosensitive drum, that is, mixing into the second developing device, will be increased in proportion though its amount of charge is low from first and therefore, the separation and collection time of the first toner having mixed will be further shortened.

Further, in the present invention, means for separating and collecting the first toner 107 having mixed into the second developing device 38 is installed near the developing sleeve 110 of the second developing device 38, and according to the present embodiment, this separating and collecting means is in the form of a receiving dish 114 located below the gap portion in which the developing sleeve 110 and the photosensitive drum 31 are opposed to each other. This receiving dish 114 is mounted in the lower portion of the opening portion of the developer container 122 of the second developing device 38.

A specific example of the present embodiment will be shown below.

The image forming apparatus of FIG. 13 was used and two-color image formation was effected by the two-color multiplex developing method. The two-component magnetic brush developing method was adopted in the first developing by the first developing device 36. The second developing by the second developing device 38 is the magnetic one-component non-contact AC developing method.

The details of conditions such as the first toner and the second toner used in the first developing and the second developing are as follows.

First Developing

- first toner: non-magnetic toner, red
  - binder resin: styrene acryl resin
  - extraneous additive: dry type silica 0.5 part by weight
  - average particle diameter: 7.0 $\mu$m
  - magnetic carrier: fluorine and acryl resin-coated magnetic particles
  - average particle diameter: 45 $\mu$m
- mixing ratio of toner and carrier: toner density 8%
- developing method: two-component magnetic brush developing method
  - S-D gap: 500 $\mu$m
  - developing bias: voltage 1500 Vpp, frequency 2000 Hz Second Developing

- second toner magnetic toner, black
  - binder resin: polyester resin
  - extraneous additive: hydrophobically treated silica 1.0 part by weight
  - average particle diameter: 7.0 $\mu$m
  - toner coat: developing sleeve coated with a thin layer having a layer thickness of about 0.8 mg/cm$^2$
- developing method: magnetic one-component non-contact alternate electric field developing method
  - S-D gap: 300 $\mu$m
  - developing bias voltage 1300 Vpp, frequency 1800 Hz, duty ratio=0.25
- developing sleeve: metallic sleeve such as SUS having a pseudo-mirror surface
- toner supply roller: a silicon single-foaminess foamed rubber roller having its surface coated with acryl with its frictional charging series with the first toner and the second toner taken into account.

The hardness of the roller was about 25°, the width of the nip thereof with the developing sleeve was 2 mm, and the roller was rotated at the same speed and in the same direction as the developing sleeve while bearing against the latter.

When the above-described single-foaminess foamed rubber roller is used as the toner supply roller, as described in Japanese Laid-Open Patent Application No. 7-44023, as compared with a case where a serial-foaminess roller or a fur brush roller is used, the air bubble portions thereof are not in communication with adjacent air bubble portions and therefore, the interior of the roller is free of the clogging by the toner and is stable and also, the surface thereof is dense and therefore, the substantial area of contact thereof with the developing sleeve increases and the effect of the application and stripping-off of the toner is enhanced. Further, as compared with a supply toner of a two-layer structure having a sponge surface covered with rubber or resin, the toner is not fused on the developing sleeve because of the moderate unevenness of the air bubbles and the function of the supply roller can be sufficiently displayed.

Prior to the actual image formation, the frictional charging series of the first toner, the second toner and the toner supply toner were examined. By the friction between the first toner and the toner supply roller, the first toner was hardly charged, and by the friction between the second toner and the toner supply roller, the second toner was negatively charged to and the supply roller was positively charged to.

When, under the above-described conditions, the first exposure 34 was effected on the uniformly negatively charged photosensitive drum 31 (an OPC photosensitive medium was used) and the first developing was effected by the reversal developing by the two-component magnetic brush developing method, the average amount of charge of the toner of the first toner image obtained on the photosensitive drum 31 was about −15 $\mu$C/g. When the surface of the photosensitive drum 31 was then uniformly charged again by the recharger 33 with a photosensitive medium inflow electric current of about −800 $\mu$A, the average amount of charge of the first toner on the photosensitive drum rose to −40 $\mu$C/g. Further, the second exposure 35 was effected and the second developing was effected by the reversal developing by the magnetic one-component non-contact alternate electric field developing method.

In this manner, two-color image formation on 10,000 sheets was carried out by the two-color multiplex developing method. As a result, color mixing by the first toner, having mixed during the second developing, was not found in the two-color image obtained, and about 30 mg of the first toner having mixed into the second developing device 38 was collected in the receiving dish 114 below the second developing device 38. The average amount of charge of this collected first toner was about −5 $\mu$C/g. The average amount of charge of the second toner did not greatly change before and after the mixing of the first toner and was −10 to −20 $\mu$C/g.

Embodiment 17

In this embodiment, it is a great feature that the average amount of charge of the first toner before and after mixing into the second developing device is prescribed.

To effectively effect only the separation and collection of the first toner in the second developing device, as is known, the amount of charge per unit weight of the first toner can be made lower than the amount of charge of the second toner, but this makes it difficult to effect the first developing faithfully, and particularly when a non-magnetic toner is used as the first toner, if the average amount of charge of this first toner is set to a level lower than the average amount of charge of the second toner which is a magnetic toner, there will be provided an image increased in the fogging and scattering of the toners.

Also, the rise of the amount of charge of the first toner in the re-charging depends on the average amount of charge on the photosensitive drum during the first developing and therefore, if the value thereof is low, the amount of charge of the first toner will not much increase still after the recharging, as is apparent from our experiment.

When the first toner image thus low in the amount of charge comes to the second developing area, there occurs the phenomenon that the mixing of the first toner into the second developing device rather increases because the first toner image is small in the reflection force on the photosensitive drum.

In the present embodiment, the non-magnetic one-component developing method using only a non-magnetic toner as the first toner is adopted and a regulating member having rubber elasticity is urged against the developing sleeve, whereby the first toner is made into a thin layer on the developing sleeve and by the bearing portion thereof, the first toner is subjected to sufficient friction charging to thereby heighten the amount of charge per unit weight of the first toner. As a result, a higher quality of image of the first developing is achieved, and since the reflection force of the first toner on the photosensitive drum is also high, the mixing of the first toner into the second developing device in the second developing area is also considerably prevented.

However, because the amount of charge of the first toner is still low, as described with respect to the prior art, some of the first toner mixes into the second developing device due to the contrast between the second developing bias and the first image portion potential, but in the present embodiment, such a positional relation on the frictional charging series is adopted that when the first toner mixes into the second developing device, as described in connection with Embodiment 1, the amount of charge retained before the mixing is decreased by the friction between the second toner and the toner supply roller. Therefore, the first toner, having mixed, adheres to the second toner with a weak force and comes to the second developing area, where it becomes unable to follow the AC component of the developing bias and scatters below the second developing device and is separated and discharged from the second developing device.

By the amount of charge of the first toner before mixing into the second developing device being thus set to a level higher than the amount of charge of the first toner after having mixed into the second developing device, the quality of the first and second toner images can be enhanced and at the same time, the efficient separation and collection of the first toner from the second developing device can be achieved.

Figure 15:
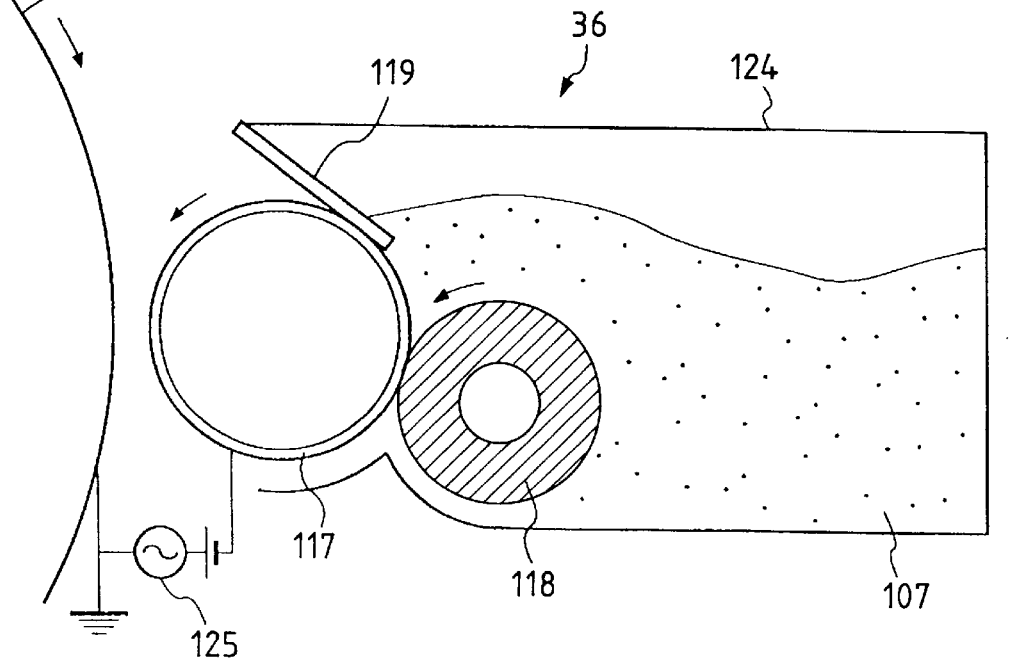
FIG. 15 is a cross-sectional view showing first developing device used in another embodiment of the present invention.

FIG. 15 is a schematic cross-sectional view of the first developing device used in the present embodiment. This first developing device 36 executes the first developing by the non-magnetic one-component non-contact developing method.

The first developing device 36 has a developer container 124 containing therein a non-magnetic toner as the first toner 107, and a developing sleeve 117 is disposed in the opening portion of the container 124 which faces the photosensitive drum 31. In order to effect the stripping off and the supply and application of the first toner 107 with respect to the developing sleeve 117, an elastic roller 118 rotatably and elastically bears against the developing sleeve 117, and an elastic blade 119 for making the first toner 107 into a thin layer on the developing sleeve 117 and having rubber elasticity for giving it frictional charging charges bears against that portion of the developing sleeve, which is downstream of the bearing portion with respect to the direction of rotation of the developing sleeve.

The developing sleeve 117 is held in non-contact with the photosensitive drum 31 in the developing area opposed to the photosensitive drum 31, and developing bias comprising an AC voltage superposed on a DC voltage is applied to the gap in this non-contact developing area by a bias voltage source 125 to thereby carry out the developing of the electrostatic latent image on the photosensitive drum 31 (the first developing), thus achieving an improvement in harmony and higher density.

Figure 16:
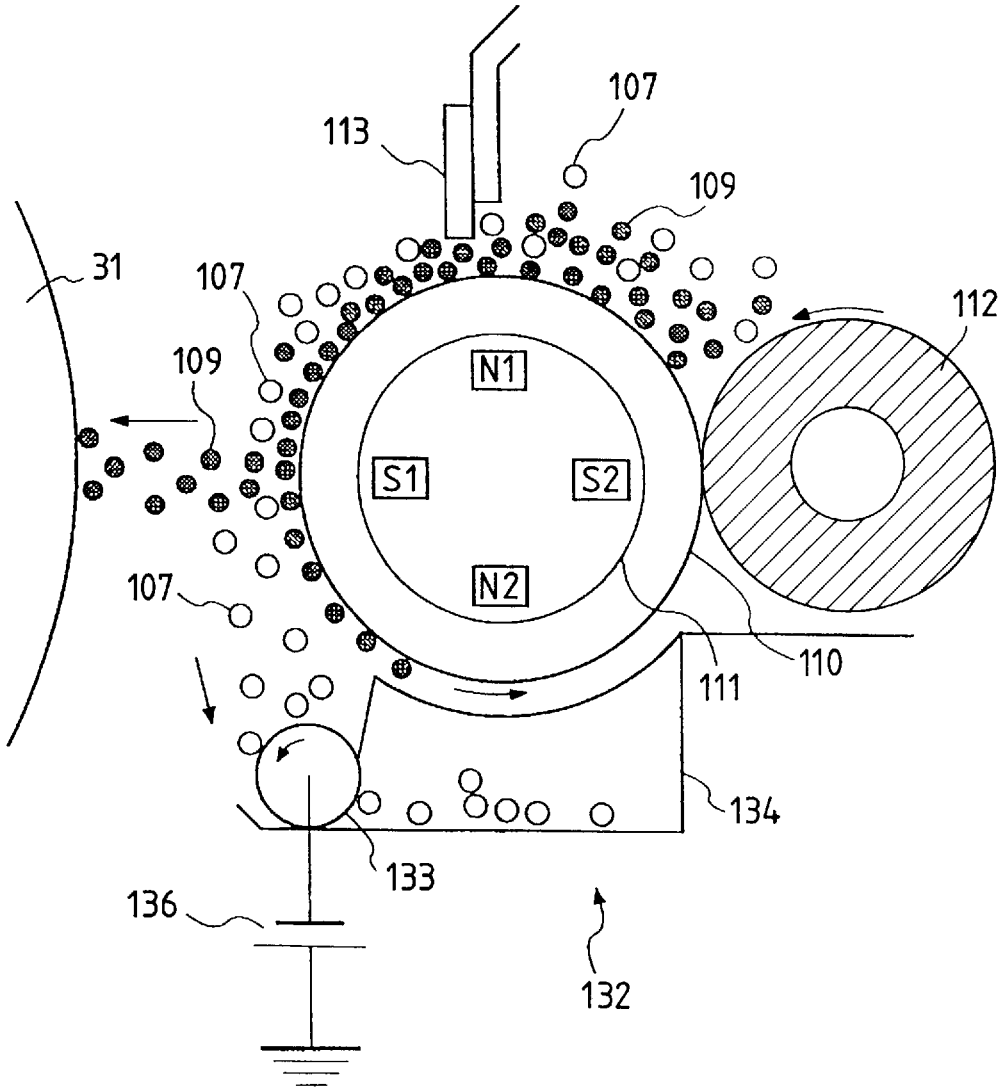
FIG. 16 is a cross-sectional view showing the essential portions of a second developing device having installed therein an electric dust collector used in the another embodiment.

The essential portions of the second developing device used in the present embodiment are shown in FIG. 16. This second developing device 38 differs from the second developing device 38 in Embodiment 16 shown in FIG. 14 in that an electric dust collector 132 is installed as the separating and collecting means, and in other aspects, the construction thereof is basically similar to that of the second developing device in Embodiment 16.

The electric dust collector 132 comprises an electrode roller 133 to which a DC power source 136 is connected, and a duct 134 containing it therein. The duct 134 has an opening portion at a location below the gap portion in which the developing sleeve 110 and the photosensitive drum 31 are opposed to each other, and the electrode roller 133 is disposed in the opening portion. In order to electrically attract and collect the first toner 107 separated and discharged out of the second developing device 38 and falling below the developing sleeve 110, a DC voltage of the order of e.g. −500 V is applied to the electrode roller 133, whereby the first toner 107 is attracted and adheres to the electrode roller 133 and is collected into the duct 134.

The details of the first developing and the second developing in the present embodiment are as follows.

First Developing

- first toner: non-magnetic toner, red
  - binder resin: polyester resin
  - extraneous additive: wet type silica 1.2 part by weight
  - average particle diameter: 7.0 $\mu$m
  - toner coat: the developing sleeve was coated with a thin layer having a layer thickness of about 0.5 mg/cm$^2$.
- developing method: non-magnetic one-component non-contact developing method
  - S-D gap: 250 $\mu$m
  - developing bias: voltage 1400 Vpp, frequency 2000 Hz, duty ratio=0.3
- elastic blade: nylon-coated urethane rubber blade, line pressure 10 g/cm
- elastic roller: silicon single-foaminess roller, hardness 25°, the width of contact with the developing sleeve 3 mm Second Developing

- second toner magnetic toner, black
  - binder resin: polyester resin
  - extraneous additive: hydrophobically treated silica 1.0 part by weight
  - average particle diameter: 7.0 $\mu$m
  - toner coat: the developing sleeve was coated with a thin layer having a layer thickness of about 0.8 mm/cm$^2$
- developing method: magnetic one-component non-contact alternate electric field developing method
  - S-D gap: 300 $\mu$m developing bias: Voltage 1300 Vpp, frequency 1800 Hz, duty ratio=0.25
- developing sleeve: metallic sleeve such as SnS having a pseudo-mirror surface
- toner supply roller: silicon single-foaminess foamed rubber roller in which with the frictional charging series with the first toner and the second toner taken into account, dry type silica was mixed as a filler with silicone rubber, and thereafter was foamed. The hardness of the roller was about 25°, the width of the nip with the developing sleeve was 2 mm, and the roller was rotated at the same speed and in the same direction as the developing sleeve while bearing against the latter.

According to the foregoing, wet type silica is dispersed in the first toner, hydrophobically treated silica is dispersed in the second toner, and dry type silica is dispersed in the toner supply roller, and from the charging characteristics of these silicas, the frictional charging series are in the relation that the second toner>the toner supply roller≧the first toner having mixed, as is apparent from out experiment.

When, under the above-described conditions, the first exposure 34 was effected on the uniformly negatively charged photosensitive drum 31 (OPC photosensitive medium) and the first developing was effected by the reversal developing by the non-magnetic one-component non-contact developing method, the average amount of charge of the toner of the first toner image obtained on the photosensitive drum 31 was about −28 μC/g and the first toner image was a good image free of fog and scatter. When the surface of the photosensitive drum 31 was then uniformly charged again by the re-charger 33 with a photosensitive medium inflow electric current of about −700 μA, the average amount of charge of the first toner on the photosensitive drum rose to −45 μC/g. Further, the second exposure 35 was effected and the second developing was effected by the reversal developing by the magnetic one-component non-contact alternate electric field developing method.

In this manner, two-color image formation on 10,000 sheets was carried out by the two-color multiplex developing method. As a result, the color mixing by the first toner having mixed during the second developing was not found in the two-color image obtained, and about 15 mg of the first toner having mixed into the second developing device 38 was collected by the electrode roller 133 of the electric dust collector 132 below the second developing device 38 (to which electrode roller was applied a negative voltage of the order of e.g. −500 V). The average amount of the charge of this collected first toner was about 0 to +5 μC/g. The average amount of charge of the second toner did not greatly change before and after the mixing of the first toner and was −10 to −20 μC/g.

Embodiment 18

In this embodiment, in addition to the relation on the frictional charging series among the first toner, the second toner and the toner supply roller, the difference between the average particle diameters of the first toner and the second toner is rendered into the first toner>the second toner to thereby further enhance the separation and collection of the first toner having mixed into the second developing device.

That is, the larger the average particle diameter of the toner, the smaller the amount of charge per unit volume and therefore, the first toner, having mixed into the second developing device, becomes smaller in the rise of the amount of charge by its friction with the toner supply roller and the second toner smaller in particle diameter preferentially adheres to the developing sleeve and therefore, the probability of the frictional contact with the developing sleeve becomes lower. Also, the first toner, having mixed into the second developing device, which has come to the second developing area while adhering to the second toner with a weak force in this state is large in its particle diameter and therefore, can hardly follow the amplitude of the AC component of the second developing bias and becomes ready to fall from gravity and come below the second developing device and thus, its separability and collectability become higher.

Figure 17:
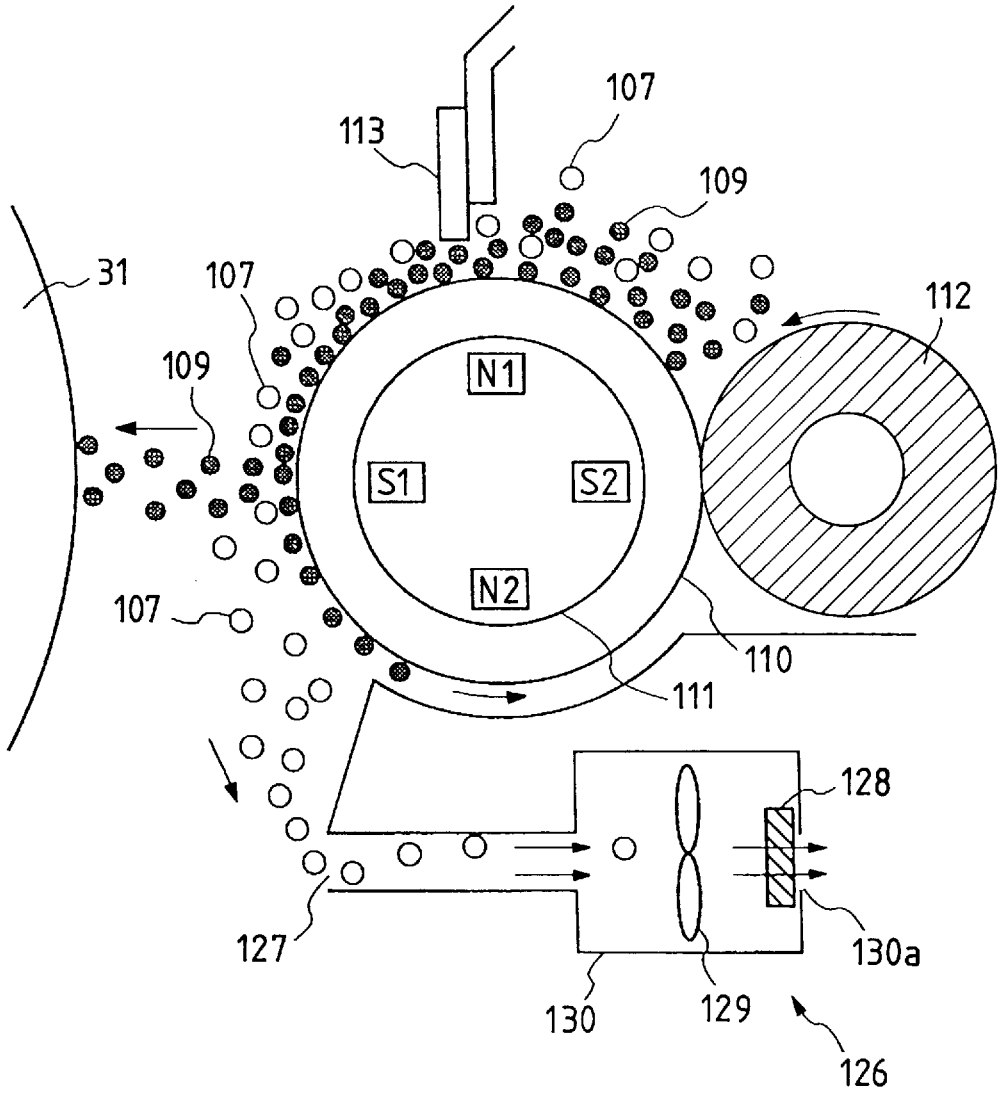
FIG. 17 is a cross-sectional view showing the essential portions of a second developing device having installed therein an air dust collector used in still another embodiment of the present invention.

In the present embodiment, as shown in FIG. 17, an air dust collector 126 as the separating and collecting means is installed below the second developing device 36. The air dust collector 126 comprises a fan 129 contained in a duct 130 and a filter 128 contained in the duct 130 and disposed in an exhaust port 130*a* rearward of the fan 129, and a duct 127 provided on that side of the duct 130, which is opposite to the filter 128, and the duct 127 faces a location below the gap portion in which the developing sleeve 110 and the photosensitive drum 31 are opposed to each other.

When the fan 129 is rotated to discharge the air in the duct 130 from the exhaust port 130*a* thereof, there is created a suction force which makes the air flow from the gap portion between the developing sleeve 110 and the photosensitive drum 31 through the duct 127 of the duct toward the interior of the duct 130. Accordingly, as shown in FIG. 17, the first toner 107 is separated and discharged out of the second developing device 38 and falls to below the developing sleeve 110, whereupon the first toner 107 is collected in the duct 130 through the duct 127.

The details of the first developing and the second developing in the present embodiment are as follows.

First Developing

- first toner: non-magnetic toner, red
  - binder resin: styrene acryl resin
  - extraneous additive: dry type silica 1.2 part by weight
  - average particle diameter: 9.0 μm
  - toner coat: the developing sleeve was coated with a thin layer having a layer thickness of about 0.5 mg/cm$^2$.
- developing method: non-magnetic one-component non-contact developing method
  - S-D gap: 250 μm
  - developing bias: voltage 1400 Vpp, frequency 2000 Hz, duty ratio=0.3
- elastic blade: nylon-coated urethane rubber, blade, line pressure 15 g/cm
- elastic roller silicon single-foaminess roller, hardness 25°, the width of contact with the developing sleeve 3 mm Second Developing

- second toner: magnetic toner, black
  - binder resin: polyester resin
  - extraneous additive: hydrophobically treated silica 1.0 part by weight
  - average particle diameter: 6.0 μm
  - toner coat: the developing sleeve was coated with a thin layer having a layer thickness of about 0.8 mg/cm$^2$.
- developing method: magnetic one-component non-contact alternate electric field developing method
  - S-D gap: 300 μm
  - developing bias: voltage 1300 Vpp, frequency 1800 Hz, duty ratio=0.25
- developing sleeve: metallic sleeve such as SUS having a pseudo-mirror surface
- toner supply roller: silicon single-foaminers rubber roller having its surface coated with acryl. The hardness of the roller was about 25°, the width of the nip with the developing sleeve was 2 mm, and the roller was rotated at the same speed and in the same direction as the developing sleeve while bearing against the developing sleeve.

When, under the above-mentioned conditions, the first exposure 34 was effected on the uniformly negatively charged photosensitive drum 31 (OPC photosensitive medium) and the first developing was effected by the reversal developing by the non-magnetic one-component non-contact developing method, the average amount of charge of the toner of the first toner image obtained on the photosensitive drum 31 was about −15 μC/g and the first toner image was a good image free of fog and scatter.

When the surface of the photosensitive drum 31 was again uniformly charged by the re-charger 33 with a photosensitive medium, inflow electric current of about −800 μA, the average amount of charge of the first toner on the photosensitive drum rose to −40 μC/g. Further, the second exposure 35 was effected and the second developing was effected by the reversal developing by the magnetic one-component non-contact alternate electric field developing method.

In this manner, two-color image formation on 10,000 sheets was carried out by the two-color multiplex developing method. As a result, the color mixing by the first toner having mixed during the second developing was not found in the obtained two-color image obtained, and 40 mg of the first toner having mixed into the second developing device 38 was collected in the air dust collector 126 below the second developing device 38. The average amount of charge of this collected first toner was nearly 0 μC/g. The average amount of charge of the second toner did not greatly change before and after the mixing of the first toner and was of the order of −15 to −20 μC/g.

In Embodiments 16 to 18 described above, the kinds of the binder resins in the toners and the kinds of the extraneous additives were changed to set the positions on the frictional charging series of the first toner and the second toner, but alternatively, a charging control agent and wax may be changed to set the positions on the frictional charging series.

While the embodiments of the present invention have been described above, the present invention is not restricted to these embodiments, but all modifications within the technical idea thereof are possible.

What is claimed is:

1. An image forming apparatus comprising:

an image bearing member;

electrostatic image forming means for forming a first electrostatic image and a second electrostatic image on said image bearing member;

a first developing device for developing the first electrostatic image on said image bearing member with a first toner; and a second developing device for developing the second electrostatic image on said image bearing member, carrying the first toner image thereon, with a second toner which is smaller in an average particle diameter than an average particle size of the first toner, said second developing device having a toner carrying member opposed to said image bearing member and carrying the first and second toners thereon wherein an average amount of charge per unit weight of the first toner after having been mixed into said second developing device is smaller than an average amount of charge per unit weight of the second toner.

2. An apparatus according to claim 1, wherein a force with which the first toner having been mixed into said second developing device is adhered on said toner carrying member, is smaller than a force with which the second toner is adhered on said toner carrying member.

3. An apparatus according to claim 2, wherein the first toner and the second toner differ in binder resin from each other.

4. An apparatus according to claim 2, wherein the first toner and the second toner have different extraneous additives added thereto.

5. An apparatus according to claim 1, further comprising collecting means for collecting the first toner from the toner carrying member of said second developing device.

6. An apparatus according to claim 5, wherein said collecting means collects the first toner below a portion in which said image bearing member and said toner carrying member are opposed to each other.

7. An apparatus according to claim 5, wherein said collecting means collects the first toner with an electrical force.

8. An apparatus according to claim 1, wherein the first toner is a non-magnetic toner and the second toner is a magnetic toner.

9. An apparatus according to claim 1, wherein the thickness of the toner layer on the toner carrying member of said second developing device is smaller than the gap between the toner carrying member and the image bearing member, and said second developing device forms an alternating electric field between the toner carrying member and the image bearing member to thereby make the toner on the toner carrying member fly to the image bearing member.

10. An apparatus according to claim 9, wherein the intensity of the peak electric field of the alternating electric field in a direction to make the toner fly to the image bearing member is greater than the intensity of the peak electric field in a direction to draw the toner back to the toner carrying member.

11. An apparatus according to claim 1, wherein the first toner having mixed into said second developing device is reduced in its amount of charge by its friction with the second toner.

12. An apparatus according to claim 1, wherein said second developing device has an elastic regulating member biased by the toner carrying member for regulating the thickness of the toner layer on the toner carrying member, and the positions on a frictional charging series are in the order of the second toner, the regulating member and the first toner.

13. An apparatus according to claim 1, wherein said second developing device has an elastic roller elastically urged against the toner carrying member for effecting the stripping and supply of the toner with respect to the toner carrying member, and the positions on a frictional charging series are the second toner>the elastic roller≧the first toner.

14. An image forming apparatus comprising:

an image bearing member;

electrostatic image forming means for forming a first electrostatic image and a second electrostatic image on said image bearing member;

a first developing device for developing the first electrostatic image on said image bearing member with a first toner; and a second developing device for developing the second electrostatic image on said image bearing member, carrying the first toner image thereon, with a second toner which is higher in the position on a frictional charging series than the first toner, said second developing device having a toner carrying member opposed to said image bearing member and carrying the first and second toners thereon wherein the average amount of charge per unit weight of the first toner after having mixed into said second developing device is smaller than an average amount of charge per unit weight of the second toner.

15. An image forming apparatus according to claim 14, wherein the first toner having mixed into said second developing device is reduced in charge amount thereof by friction with the second toner.

16. An image forming apparatus according to claim 14, wherein the first toner and the second toner differ in binder resin from each other.

17. An image forming apparatus according to claim 14, wherein the first toner and the second toner have different extraneous additives added thereto.

* * * * *

UNITED STATES PATENT AND TRADEMARK OFFICE

CERTIFICATE OF CORRECTION

PATENT NO. : 5,890,038

DATED : March 30, 1999

INVENTOR(S) : KEISHI OHSAWA, ET AL.

It is certified that error appears in the above-identified patent and that said Letters Patent is hereby corrected as shown below:

COLUMN 1,
Line 39, "contact-with" should read --contact with--.

COLUMN 3,
Line 27, "charged" should read --charged,--.

COLUMN 5,
Line 9, "voltage" should read --voltage,--.

COLUMN 20,
Line 18, "1" should read --3--; and
Line 27, "instance" should read --instances--.

COLUMN 31,
Line 61, "2" should read --≥--.

COLUMN 37,
Line 59, "toner" should read --toner,--, and "diameter" should read --diameter,--.

UNITED STATES PATENT AND TRADEMARK OFFICE

CERTIFICATE OF CORRECTION

PATENT NO. : 5,890,038

DATED : March 30, 1999

INVENTOR(S) : KEISHI OHSAWA, ET AL.

It is certified that error appears in the above-identified patent and that said Letters Patent is hereby corrected as shown below:

COLUMN 39,
Line 19, "image obtained," should read --image,--.

Signed and Sealed this

Ninth Day of November, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,890,038
DATED : February 7, 1996
INVENTOR(S) : Keishi Ohsawa, et al.

It is certified that error appears in the above-identified patent and that said Letters Patent is hereby corrected as shown below:

Column 1,

At the top of the page, "IMAGE FORMING APPARATUS IN WHICH CARRING FORCE FOR A MIXING TONER BY A TONER CARRYING MEMBER IS MADE SMALL" should read -- IMAGE FORMING APPARATUS COMPRISING FIRST AND SECOND DEVELOPING DEVICES DEVELOPING FIRST AND SECOND ELECTROSTATIC IMAGES, RESPECTIVELY, ON A IMAGE BEARING MEMBER WHICH CAUSES THE FORCE WITH WHICH A FIRST TONER IS CARRIED ON TONER CARRYING MEMBER OF THE SECOND DEVELOPING DEVICE TO BE SMALLER THAN THE FORCE WITH WHICH A SECOND TONER IS CARRIED THEREON --

Signed and Sealed this

Fourteenth Day of August, 2001

*Attest:*

Nicholas P. Godici

*Attesting Officer*

NICHOLAS P. GODICI
*Acting Director of the United States Patent and Trademark Office*